US007549511B2

(12) United States Patent
Marocco

(10) Patent No.: US 7,549,511 B2
(45) Date of Patent: Jun. 23, 2009

(54) EXHAUST SOUND AND EMISSION CONTROL SYSTEMS

(76) Inventor: Gregory M. Marocco, 49 Stoney Brook Rd., Montville, NJ (US) 07045

( * ) Notice: Subject to any disclaimer, the term of this patent is extended or adjusted under 35 U.S.C. 154(b) by 0 days.

(21) Appl. No.: 11/979,067

(22) Filed: Oct. 30, 2007

(65) Prior Publication Data

US 2009/0107761 A1 Apr. 30, 2009

Related U.S. Application Data

(63) Continuation-in-part of application No. 11/907,611, filed on Oct. 15, 2007, which is a continuation-in-part of application No. 11/198,484, filed on Aug. 8, 2005, now Pat. No. 7,281,606, which is a continuation-in-part of application No. 10/663,751, filed on Sep. 17, 2003, now Pat. No. 6,935,461, which is a continuation-in-part of application No. 09/135,804, filed on Aug. 18, 1998, now abandoned, which is a continuation-in-part of application No. 10/252,506, filed on Sep. 24, 2002, now Pat. No. 6,651,773.

(51) Int. Cl.
*F01N 1/08* (2006.01)
*F01N 1/02* (2006.01)

(52) U.S. Cl. ..... 181/270; 181/268; 181/275

(58) Field of Classification Search ..... 181/270, 181/265, 268, 269, 272, 275, 281, 282, 264; 60/299, 312, 322, 301, 302
See application file for complete search history.

(56) References Cited

U.S. PATENT DOCUMENTS 2,573,474 A 10/1951 Marx
2,948,210 A * 8/1960 Conlan ..... 454/262
3,061,416 A 10/1962 Kazokas
3,149,925 A * 9/1964 Scheitlin ..... 422/176
3,169,836 A * 2/1965 Davis ..... 422/171
3,201,338 A 8/1965 Pennington
3,370,673 A * 2/1968 Jettinghoff ..... 181/265
3,695,851 A 10/1972 Perga
3,817,714 A 6/1974 Wiley
4,011,922 A 3/1977 Goplen (Continued)

FOREIGN PATENT DOCUMENTS

EP 475398 3/1992

(Continued)

*Primary Examiner*—Edgardo San Martin
(74) *Attorney, Agent, or Firm*—Richard C. Litman

(57) ABSTRACT

The exhaust sound and emission control systems reduce sound and noxious emissions from an automotive exhaust. The system may have an exhaust resonator having one or more catalytic converter elements in combination therewith in a single device. Alternatively, the system may have multiple angularly disposed chambers therein, with a series of swept baffles or guides in one of the chambers, thereby combining resonator and muffler functions in a single device. In another alternative, the system has a series of longitudinal tubes therein in combination with a series of V-shaped guides or vanes, combining catalytic converter, muffler, and resonator functions in a single device. The various elements of the system, e.g., catalytic converter element(s), double wall shell, perforated tubes and multiple flow paths, interconnecting crossover tubes, etc., may be combined with one another as practicable.

18 Claims, 20 Drawing Sheets

U.S. PATENT DOCUMENTS

| | | | | | |
|---|---|---|---|---|---|
| 4,032,310 | A | | 6/1977 | Ignoffo | |
| 4,050,903 | A | | 9/1977 | Bailey et al. | |
| 4,164,267 | A | | 8/1979 | Meineke et al. | |
| 4,364,761 | A | | 12/1982 | Berg et al. | |
| 4,393,652 | A | | 7/1983 | Munro | |
| 4,425,304 | A | | 1/1984 | Kawata et al. | |
| 4,426,844 | A | | 1/1984 | Nakano | |
| 4,541,240 | A | | 9/1985 | Munro | |
| 4,671,381 | A | * | 6/1987 | Rascov | 181/255 |
| 4,809,812 | A | * | 3/1989 | Flugger | 181/268 |
| 4,851,015 | A | | 7/1989 | Wagner et al. | |
| 5,009,065 | A | | 4/1991 | Howe et al. | |
| 5,014,510 | A | | 5/1991 | Laimbock | |
| 5,016,438 | A | | 5/1991 | Harris | |
| 5,043,147 | A | | 8/1991 | Knight | |
| 5,108,716 | A | | 4/1992 | Nishizawa | |
| 5,123,502 | A | * | 6/1992 | Flugger | 181/264 |
| 5,183,976 | A | | 2/1993 | Plemons, Jr. | |
| 5,206,467 | A | | 4/1993 | Nagai et al. | |
| 5,220,789 | A | | 6/1993 | Riley et al. | |
| 5,248,859 | A | | 9/1993 | Borla | |
| 5,265,420 | A | | 11/1993 | Rutschmann | |
| 5,304,749 | A | * | 4/1994 | Crandell | 181/264 |
| 5,325,666 | A | | 7/1994 | Rutschmann | |
| 5,355,973 | A | | 10/1994 | Wagner et al. | |
| 5,378,435 | A | | 1/1995 | Gavoni | |
| 5,388,408 | A | | 2/1995 | Lawrence | |
| 5,398,504 | A | | 3/1995 | Hirota et al. | |
| 5,426,269 | A | | 6/1995 | Wagner et al. | |
| 5,444,197 | A | * | 8/1995 | Flugger | 181/264 |
| 5,477,014 | A | | 12/1995 | Dunne et al. | |
| 5,521,339 | A | | 5/1996 | Despain et al. | |
| 5,578,277 | A | | 11/1996 | White et al. | |
| 5,650,599 | A | | 7/1997 | Madden et al. | |
| 5,739,484 | A | * | 4/1998 | Jones | 181/264 |
| 5,881,554 | A | | 3/1999 | Novak et al. | |
| 5,936,210 | A | * | 8/1999 | Borneby et al. | 181/264 |
| 5,949,035 | A | * | 9/1999 | Herold | 181/282 |
| 5,992,560 | A | | 11/1999 | Matsuoka et al. | |
| 6,006,859 | A | | 12/1999 | Hussaini | |
| 6,076,632 | A | * | 6/2000 | Schuhmacher et al. | 181/282 |
| 6,089,347 | A | * | 7/2000 | Flugger | 181/264 |
| 6,109,026 | A | * | 8/2000 | Karlsson et al. | 60/302 |
| 6,286,623 | B1 | | 9/2001 | Shaya | |
| 6,341,664 | B1 | * | 1/2002 | Gerber | 181/282 |
| 6,394,225 | B1 | | 5/2002 | Yasuda | |
| 6,431,311 | B1 | | 8/2002 | Brown et al. | |
| 6,651,773 | B1 | | 11/2003 | Marocco | |
| 6,776,257 | B1 | | 8/2004 | Shaya | |
| 6,935,461 | B2 | | 8/2005 | Marocco | |
| 7,219,764 | B1 | | 5/2007 | Forbes | |
| 7,281,606 | B2 | * | 10/2007 | Marocco | 181/270 |
| 2003/0042071 | A1 | * | 3/2003 | Butler | 181/270 |
| 2005/0224284 | A1 | * | 10/2005 | Ohno et al. | 181/272 |
| 2005/0258001 | A1 | * | 11/2005 | Ryczek et al. | 181/272 |
| 2006/0054384 | A1 | * | 3/2006 | Chen | 181/272 |
| 2006/0090957 | A1 | | 5/2006 | Stuber | |
| 2007/0205046 | A1 | * | 9/2007 | Newberry | 181/270 |
| 2008/0035418 | A1 | * | 2/2008 | Marocco | 181/211 |

FOREIGN PATENT DOCUMENTS

| | | |
|---|---|---|
| JP | 55-043262 | 3/1980 |
| JP | 57-041414 | 3/1982 |
| JP | 62-291413 | 12/1987 |
| JP | 64-012017 | 1/1989 |
| JP | 02-169812 | 6/1990 |
| JP | 06-257421 | 9/1994 |
| JP | 10-141050 | 5/1998 |

* cited by examiner

EXHAUST SOUND AND EMISSION CONTROL SYSTEMS

REFERENCE TO RELATED PATENT APPLICATIONS

This application is a continuation-in-part of U.S. patent application Ser. No. 11/907,611 filed on Oct. 15, 2007, which is a continuation-in-part of U.S. patent application Ser. No. 11/198,484 filed on Aug. 8, 2005, now issued as U.S. Pat. No. 7,281,606 on Oct. 16, 2007, which is a continuation-in-part of U.S. patent application Ser. No. 10/663,751, filed on Sep. 17, 2003, now issued as U.S. Pat. No. 6,935,461 on Aug. 30, 2005, which is a continuation-in-part of U.S. patent application Ser. No. 09/135,804 filed on Aug. 18, 1998, now abandoned, and U.S. patent application Ser. No. 10/252,506 filed on Sep. 24, 2002, now issued as U.S. Pat. No. 6,651,773 on Nov. 25, 2003.

BACKGROUND OF THE INVENTION

1. Field of the Invention

The present invention relates generally to automobile exhaust sound and emission control, including a catalytic exhaust converter and resonator installed within the exhaust system for the reduction of exhaust noise, and to an exhaust sound attenuation and control system having multiple flow paths for reducing exhaust noise.

2. Description of the Related Art

By the time of the 1950s, it was becoming apparent that the ever-increasing volume of automobile and truck traffic was generating exhaust emissions, which were adversely affecting the environment. This was particularly true in urban areas and other areas where geographic and meteorological conditions combined to create areas where such emissions do not readily dissipate. Accordingly, by the late 1960s, various regulations were being implemented to require equipment to reduce exhaust emissions output from automobiles, particularly in California and other urban areas.

While early emissions control efforts provided some relief, standards have become increasingly strict in order to keep pace with the ever-increasing volume of automobile and truck traffic throughout the U.S.A. With the development of the catalytic converter, which uses one or more noble metals such as platinum, rhodium, and/or palladium to produce an oxidizing and/or reducing catalytic reaction with the exhaust products and heat generated by the exhaust, a real breakthrough was achieved in the control of vehicle emissions. An automobile equipped with one or more catalytic converters was capable of meeting most, if not all, of the exhaust emissions standards of the time, and the use of catalytic converters became commonplace on automobiles and light trucks powered by spark ignition engines in the U.S.A.

However, long before the recognition of chemical or particulate automobile exhaust emissions as a hazard, another type of automobile exhaust emission had been recognized, i.e., noise or sound. In fact, legislation in virtually every area of the world requires motor vehicles to have equipment that reduces this other emission. Accordingly, mufflers, resonators and other such sound attenuating devices have been known for many years, since shortly after the very earliest development of the internal combustion engine. These two types of emissions control devices, i.e., catalytic converters and mufflers or other sound attenuating devices, have generally not been combined into a single unit due to conflicting characteristics and physical requirements.

In the case of exhaust silencing devices, the maximum desired temperatures for such devices in operation are generally relatively low in comparison to the temperatures achieved in catalytic converters. Mufflers, resonators, and such sound attenuating devices are generally constructed of mild steel, perhaps with an aluminized exterior coating. Very high temperatures cause the aluminized coating to be burned off, and cause both the interior and (after removal of any coating) exterior to be oxidized, to the point of burn-through or rust-through, in relatively short order. While mufflers and other related devices have been constructed of stainless steel in order to reduce oxidation problems, these devices are relatively costly due to the material used and the difficulty in working with such material, in comparison to mild steel. Many, if not most, automobile owners would rather replace a standard steel exhaust system once or twice during their ownership of the car, rather than pay for a replacement system which costs perhaps three times that of a standard, mild steel system.

On the other hand, catalytic converters require relatively high temperatures for efficient operation. If a catalytic converter does not reach a minimum temperature, the catalytic reactions therein will be greatly reduced. Thus, most catalytic converters are constructed of relatively costly materials in order to withstand the heat generated therein. Even so, most converters are installed at some distance from the engine in order to preclude being subjected to excessive heat, which could damage them.

While mufflers are generally installed toward the extreme downstream end of the exhaust system, many exhaust systems also incorporate a resonator. Resonators are also sound attenuation devices, but operate on a completely different principle than that of the muffler. The muffler is adapted to cancel most sounds therein by reflecting the sounds (and the exhaust) back and forth through a series of parallel pipes therein, and by forcing the exhaust gases laterally outwardly through relatively small passages in the pipes. The resonator is adapted to pass the exhaust gases therethrough with little or no impedance, while canceling or absorbing sounds within a certain relatively well defined frequency range. This range is generally relatively high, with the muffler being relied upon for the attenuation of lower exhaust frequencies.

As the resonator is adapted to attenuate different frequencies than the muffler, and operates on a different principle, it is generally placed elsewhere in the exhaust system, somewhat forwardly of the muffler, although the resonator may be placed either upstream or downstream of the muffler. The catalytic converter is typically installed forward of the muffler in an automobile, in order to avoid excessive exhaust heat while still accepting sufficient exhaust heat to function. While resonators do not generate internal heat due to chemically reacting the exhaust products, as do catalytic converters, they still must be structured to accept a relatively high exhaust temperature due to their location relatively near the engine. However, heretofore no combining of a catalytic converter and a resonator has been accomplished, to the knowledge of the present inventor.

Thus, exhaust sound and emission control systems solving the aforementioned problems is desired.

SUMMARY OF THE INVENTION

The exhaust sound and emission control systems of the present invention comprise a series of devices for attenuating sound and noxious emissions primarily for, but not limited to, an automobile exhaust system. In one aspect, the system relates to a catalytic converter and resonator combination, combined within a single canister or shell. The combination device may be installed between the engine and a muffler at or near the downstream or exhaust outlet end of the exhaust system, with the system perhaps including an additional catalytic converter(s) upstream of the catalytic converter and resonator combination. The placement of the catalytic converter and resonator combination forward of the muffler and tailpipe of the exhaust system, with the converter element forward of the resonator element, ensures that the converter portion of the combination will receive exhaust gases at a sufficiently high temperature to produce the desired catalytic reaction and thereby oxidize and/or reduce the exhaust components to harmless products. The catalytic converter element may be formed of a thin wall ceramic material, for further efficiency. Heated and/or electronic catalytic converter devices may be implemented to enhance emissions reduction.

The resonator portion of the combination is a straight through, free flow configuration, with all components being concentric to one another in the single exhaust configuration for greater efficiency. The resonator includes a central pipe with a plurality of relatively small holes or passages therethrough, for attenuating or canceling a relatively narrow band of frequencies produced by the engine exhaust. An alternative embodiment may include a dual exhaust version, with two side by side resonator pipes behind the catalytic converter portion, and either embodiment may include one or more catalytic converter elements therein.

As noted above, a resonator operates on the principle of canceling or impeding certain frequencies of sound within a relatively narrow band or range. The loudest sounds produced by various internal combustion engines will vary in frequency, depending upon the engine configuration (number of cylinders, cylinder layout, etc.), and other factors, including installation, etc. Accordingly, it is important to be able to adjust or tune a resonator for a given installation, in order to attenuate sounds within a predetermined range. The present combination catalytic converter and resonator invention may be structured to provide for such adjustment at the time of manufacture or assembly, as desired. Also, additional sound absorbing material may be installed within the device if desired, surrounding the inner resonator pipe or tube, to absorb sounds which might otherwise be transmitted through the outer shell of the device.

In another aspect, the system of the present invention comprises an exhaust sound attenuation and control system for use with internal combustion engines of any practicable type and configuration, which combines the functions of a muffler and a resonator. In this aspect, the system generally comprises an outer shell containing multiple flow paths therein for exhaust gases, with the flow paths resulting in the canceling of certain frequencies of exhaust noise (i.e., acting as a resonator) and also lowering exhaust noise generally throughout the frequency range (i.e., acting as a muffler). Internal components of the present exhaust system may be coated with emissions reduction material in order to provide some limited catalyzing of exhaust emissions, as well.

In this regard, the system is configured so that the cross-sectional areas of the internal and outlet pipe passages are at least equal to, and are preferably greater than, the cross-sectional area of the inlet pipe. This provides relatively free flowing characteristics for the present system, thus reducing back pressure in the exhaust system and improving the efficiency of operation of the associated engine.

Such a system is relatively compact, particularly in comparison to the separate muffler and resonator systems of the prior art. The compact, integrated configuration of the present system enables it to be installed at virtually any location in the vehicle exhaust system. The system may be formed of high temperature resistant materials (e.g., corrosion resistant steel, etc.), as required, for installing adjacent to the vehicle engine. Additionally, the exterior and/or interior of the body may be covered with a ceramic jet coat or comparable thermal coating to retain internal temperature, significantly reducing the external temperature and creating more efficient emission reduction and enabling the unit to be in closer proximity to surrounding objects.

The system may be adapted for use as a single or multiple system, with crossover pipes as required. The crossover pipes may comprise a single pipe or a plurality of pipes between two or more exhaust control devices of the present invention, and may connect similar or dissimilar chambers or passages within the different devices, as desired, to enhance the versatility of the system.

In still another aspect, the system of the present invention essentially comprises a resonator and catalytic converter combination together with structural features associated with a muffler. In this configuration, the system incorporates a device with a series of internal tubes of different lengths and diameters, with exhaust flow being separated to pass through the various tubes. This results in the canceling of various frequencies, according to the resonance of a column of gas within each of the pipes. The device may also incorporate a series of V-shaped vanes or guides therein, and one or more catalytic converter elements. Any of the various components of any of the embodiments disclosed herein, may be combined where practicable with any of the other components of any of the other embodiments.

An alternative series of embodiments includes a sinusoidal primary gas flow path comprising three parallel segments, which fold back upon one another. A generally rhomboid flow divider is positioned in the central segment or leg, and divides the primary flow into two substantially equal portions. Secondary flow paths may be provided by passages and perforations through the various baffles and walls of the device, and one or more catalytic converter elements may be incorporated with the device.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an exhaust system for attenuating the sound, and optionally treating the emissions, of an internal combustion engine. The present exhaust system is more than just a muffler, and combines aspects of a muffler with aspects of a resonator unit as well. Optionally, the present system may incorporate catalytic materials for emissions treatment of the exhaust gases flowing therethrough, as noted above. Thus, the present exhaust treatment system provides a more compact, lighter weight, and more economical device for treating and controlling sound and other emissions of the exhaust of an internal combustion engine, replacing the multiple units required by conventional exhaust systems.

Figure 1:
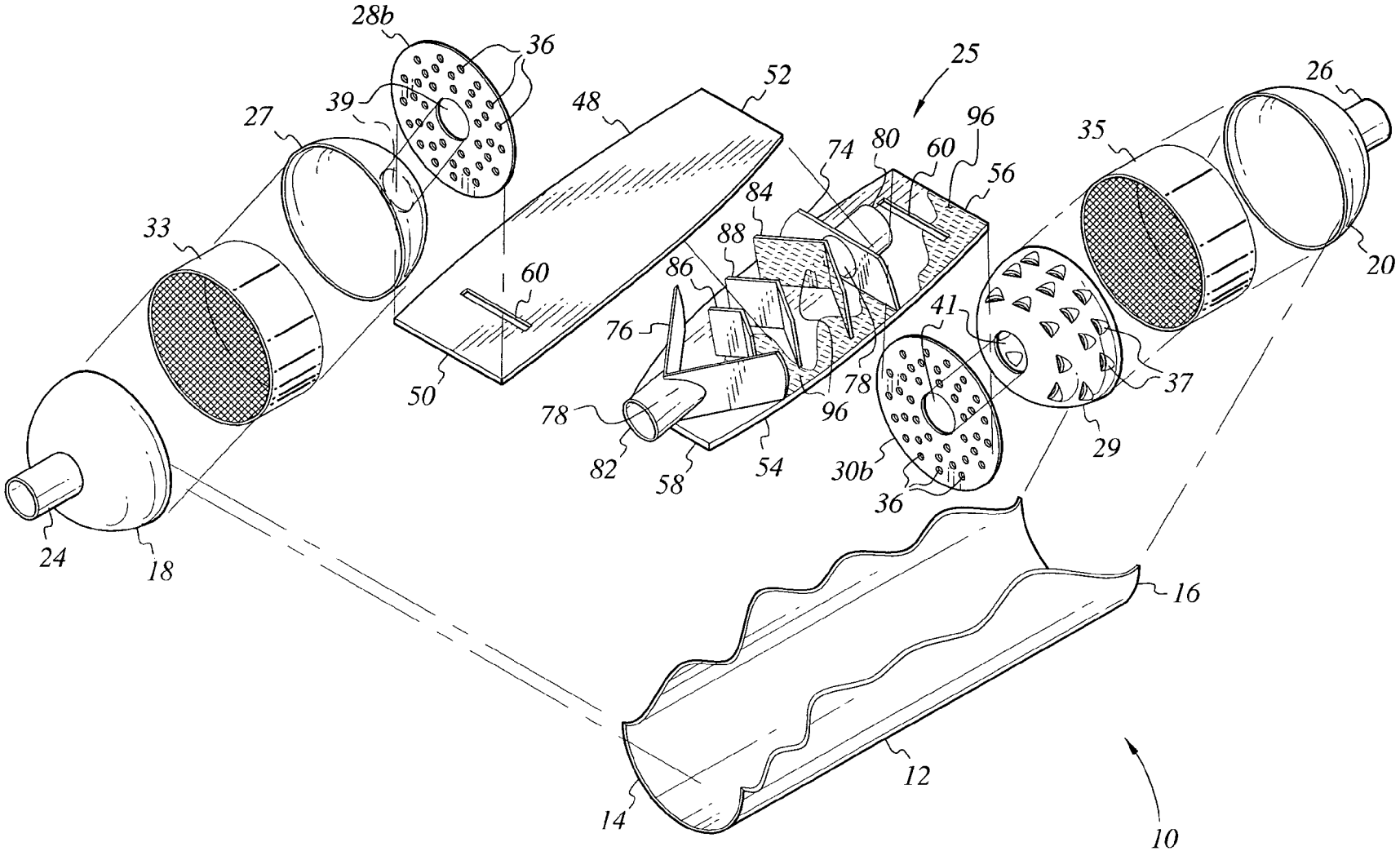
FIG. 1 is an exploded perspective view in partial section of a first embodiment of a single exhaust catalytic converter and resonator combination of the present invention, showing its structure and features.
Figure 2:
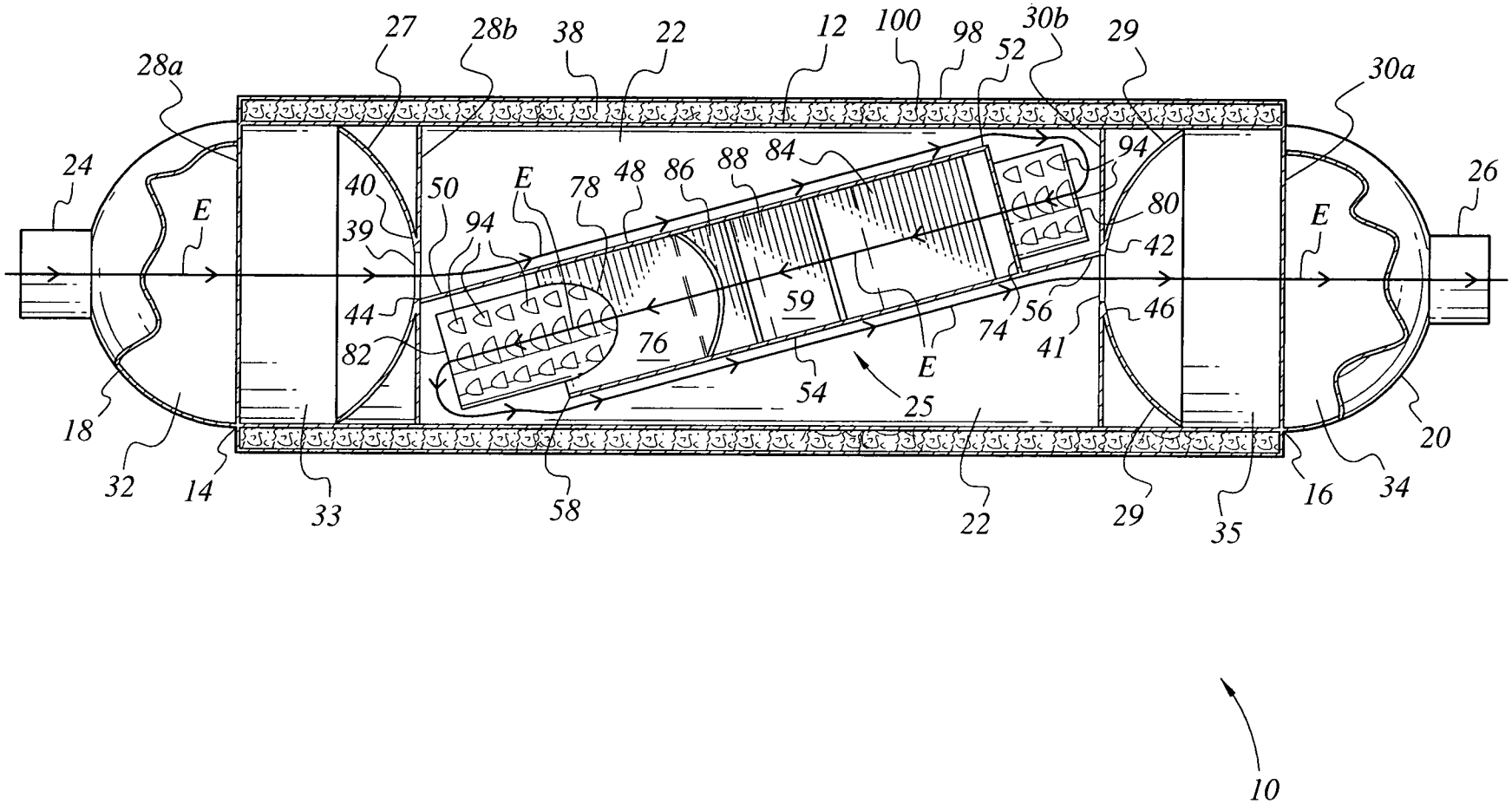
FIG. 2 is a side elevation view in section of the device of FIG. 1 showing the assembly of the components, and including further sound absorbing materials therein.

FIGS. 1 and 2 of the drawings provide exploded perspective and sectional views of a first embodiment 10 of the present exhaust system, comprising a generally cylindrical unit. The internal components of the exhaust system 10 are enclosed in an elongate external housing or shell 12 (shown with one side broken away in FIG. 1, for clarity in the drawing Fig.) having an inlet end 14 and opposite outlet end 16. Each end 14 and 16 of the housing 12 has an external end plate sealed thereto, respectively inlet end plate 18 and outlet end plate 20. These external end plates 18 and 20 may comprise opposed convex hemispherical shells, as shown, or may be flat or have some other shape, as desired. The additional internal volume of the illustrated convex hemispherical external end plates 18 and 20 may provide additional benefits, as discussed further below.

The external housing 12, external inlet end plate 18, and external outlet end plate 20 define an internal volume 22 (indicated in FIG. 2), which is sealed from the outer environment except for their respective inlet pipe 24 and outlet pipe 26. In the case of the hemispherical inlet and outlet plates 18 and 20, the inlet and outlet pipes 24 and 26 preferably penetrate their respective external inlet and outlet plates 18 and 20 to exit into respective inlet and outlet end chambers 32 and 34, further communicating at least indirectly with the interior volume 22 as described further below.

The central volume 22 of the exhaust system embodiment 10 includes a generally medially disposed exhaust baffle assembly 25, with exhaust gases traveling a generally sinusoidal exhaust gas path through the assembly 25, as indicated by the exhaust gas path arrow E. The extent of the internal baffle assembly 25 is defined by a baffle assembly inlet end plate **28*b* and an opposite baffle assembly outlet end plate 30*b*. Similar foraminous end plates 28*a* and 30*a* may be provided between the respective external end elements 18, 20 and the inlet and outlet ends 14 and 16 of the housing shell 12, as desired. Alternatively, the intermediate end plates 28*a* and 30*a* may comprise open rings, with their inner diameters matching the major diameters of the external end plates 18 and 20 and their outer diameters matching the diameter of a secondary outer shell 98, where implemented with the device. These baffle assembly inlet and outlet plates 28*b* and 30*b* respectively capture a concave, transverse internal inlet baffle 27 and opposite outlet baffle 29 immediately outboard thereof, with the external inlet end plate 18 and its nearby internal inlet baffle 27 defining an inlet catalytic converter chamber 32 therebetween and the opposite external outlet end plate 20 and its nearby internal outlet baffle 29 defining an outlet catalytic converter chamber 34 therebetween. Each of these chambers 32 and 34 may contain a catalytic converter element therein, e.g., inlet catalytic converter element 33 and outlet catalytic converter element 35. The two catalytic converter elements 33 and 35 span the entire diameter or width of the internal volume of their respective chambers 32 and 34, thereby requiring all exhaust gases to pass therethrough when the elements 33 and 35 are installed. Either the inlet element 33, or the outlet element 35, or both elements 33 and 35, may be installed within the exhaust system embodiment 10**, as desired.

Each of the baffle assembly end plates **28*b* and 30*b* may include a series of perforations 36 therethrough, which allow exhaust gases to circulate into the inlet and outlet end volumes 32 and 34 of the system. It will also be noted that either or both of the internal end baffles 27 and 29 may be perforated (louvered, etc.), as shown in the exemplary internal outlet end baffle 29 in FIG. 1. These end volumes 32 and 34 may include some form of sound absorbent material 38 installed therein (shown in FIG. 2, e.g., glass fiber roving, etc.) to provide additional sound control, depending upon the sound level output of the engine, the size and sound control attributes of the remainder of the system, and the sound output level and quality desired. It will also be seen that the internal end plates 28***b* and 30*b* may be made considerably longer or thicker than shown in the drawings, and with their passages or perforations 36 coated internally with a catalytically reactive material, may provide a significant catalytic conversion effect when the system is modified to provide a net exhaust flow through the end volumes 32 and 34. Such catalytically modified internal end plates 28*b* and 30*b* may be installed in lieu of, or in addition to, the catalytic converter elements 33 and 35 illustrated in FIGS. 1 and 2.

While FIG. 1 illustrates the various components that comprise the present exhaust system 10, FIG. 2 provides an illustration of the exhaust gas flow paths that pass through the system 10. For the sake of reference to the installation positions of the various internal panels, plates, and baffles comprising the internal structure of the device 10, the inlet and exhaust passages 39 and 41 of the respective baffle assembly inlet and outlet end plates 28*b* and 30*b* and their respective joined internal inlet and outlet baffles 27 and 29 are considered to have a first side, respectively 40 and 42, and an opposite second side, respectively 44 and 46, indicated in FIG. 2 of the drawings. The diameter across the two sides 40,44 of the inlet passage 39 and sides 42, 46 of the outlet passage 41, define their respective cross-sectional areas. This is an important consideration for the flow of exhaust gases to, from, and through the present system 10, as discussed further below.

A first separator panel or baffle 48 has a first end 50 that is sealed across the internal inlet plate 28*b*, adjacent the second side 44 of the inlet passage 39. This first separator panel 48 is sloped relative to the longitudinal axis of the system 10, and extends angularly through the majority of the length of the housing 12 toward the internal wall of the housing 12, where it terminates at its second end 52. The second end 52 of the first separator panel 48 is spaced away from the internal surface of the housing 12, and defines a cross-sectional area therebetween. This cross-sectional area is in the form of a circular segment, and is at least as great as (or greater than) the cross-sectional area of the inlet pipe 24 and inlet passage 39.

A second separator panel 54 has a first end 56 that is sealed across the internal outlet plate 30*b*, adjacent the first side 42 of the outlet pipe 26. The second separator panel 54 is also sloped relative to the longitudinal axis of the system 10, and extends angularly through the majority of the length of the housing 12 toward the internal wall of the housing 12, where it terminates at its second end 58. The two separator panels 48 and 54 are preferably substantially parallel to one another, and define an exhaust gas intermediate chamber 59 therebetween, as discussed further below. The second end 58 of the second separator panel 54 is also spaced away from the internal surface of the housing 12 and defines a cross-sectional area therebetween, essentially like the cross-sectional area between the second end 52 of the first separator panel 48 and the wall or housing 12 of the assembly 10. As in the case of the first separator panel 48, the cross-sectional area between the second end 58 of the second separator panel 54 is also at least as great as (or greater than) the cross-sectional areas of the inlet and outlet pipes 24 and 26 and inlet and outlet passages 39 and 41. Either or both separator panels 48 and 54 may have smooth and planar surfaces, as shown, or may alternatively have irregular or roughened (e.g., corrugated, etc.) surfaces in order to increase their surface areas (to provide a greater reactive area if coated with a catalytic material) and/or to alter the gas flow through the device. This principle may be applied to similar components in other embodiments described herein.

Each of the two separator panels 48 and 54 may include a lateral exhaust gas pressure balance passage 60, which extends thereacross and near the respective first ends 50 and 56 of the two panels 48 and 54. These two pressure balance passages 60 provide alternative exhaust gas passages through the interior 22 of the system 10, with pressure pulses on each side of the panels 48 and 54 tending to cancel one another through the balance passages 60.

The above described layout of the separator panels or baffles 48 and 54 results in the inlet chamber 32, intermediate chamber 59, and outlet chamber 34 communicating with one another sequentially, as the exhaust gases flow from the inlet pipe 24 into the inlet chamber 32, through its catalytic converter element 33 and into the primary housing volume 22, through the gap between the second end 52 of the first separator panel 48 and the housing 12, back through the intermediate chamber 59, then through the gap between the second end 58 of the second separator panel 54 and the housing 12, through the primary housing volume 22 and into the outlet chamber 35 and its catalytic converter element 35, and finally out the outlet pipe 26. This sinusoidal primary exhaust gas pathway is preferably at least two and one half times the external length of the system 10, due to the lengths of the two separator panels 48 and 54 extending within the housing 12 for at least half of the length of the housing 12, along with the additional internal entry and exit pipes (discussed further below) for the intermediate passage area 59.

The intermediate chamber 59 further includes a series of generally lateral baffles or vanes thereacross, which serve to further attenuate the sound of the exhaust as it passes through the present system 10. Intermediate chamber entry and exit baffles, respectively 74 and 76, extend laterally across the entry and exit ends of the intermediate passage area 59. These baffles extend completely across the interior of the housing 12, extending from the second end 52 of the first separator panel 48 to the second separator panel 54 (for the entry baffle 74) and from the second end 58 of the second separator panel 54 to the first separator panel 48 (for the exit baffle 76), normal to the two panels 48 and 54.

These two baffles 74 and 76 seal the intermediate passage area 59, with the exception of their passages 78 through which all exhaust gases must pass to travel into and from the intermediate chamber 59. Each internal baffle passage 78 may include a supplementary pipe or resonator tube extending therefrom, with the entry baffle 74 having an internal entry pipe or tube 80 extending therefrom and toward the outlet end 16 of the system 10, and the exit baffle 76 having an exit pipe or tube 82 extending therefrom and toward the inlet end 14 of the system 10. These two internal pipes or tubes 80 and 82 add some additional length to the intermediate chamber 59 for further tuning effect, and serve to duct and guide the exhaust gases into and from the intermediate chamber 59. Either or both pipes or tubes 80 and/or 82 may have circular cross sections, as shown in FIG. 1, or may have some non-circular cross section(s), e.g., square or other regular or irregular polygonal shape, oval, ellipsoid, etc., as desired. Other embodiments described herein may also include these alternatives.

The intermediate chamber 59 further includes a series of generally chevron-shaped intermediate baffles or vanes extending between the two separator panels 48 and 54, and installed between the intermediate chamber entry and exit baffles 74 and 76. These baffles or vanes extend from a relatively wider first intermediate baffle 84 to a relatively narrower last intermediate baffle 86, with one or more secondary intermediate baffles 88 disposed therebetween. Each of these intermediate baffles 84 through 88 is oriented with the apex of the V facing the intermediate chamber entry baffle 74, and extends between the two separator panels 48 and 54. However, some lateral space is provided for exhaust gas flow around the ends of the intermediate baffles 84 through 88, with each of the baffles 84 through 88 having a narrower width from the entry baffle 74 toward the opposite exit baffle 76. Alternatively, the various intermediate baffles 84 through 88, and/or the entry and exit baffles 74 and/or 76, may have more generally swept shapes, with some lateral curvature at their central areas and/or extending to their lateral extremities, as desired. This alternative may also be provided for other embodiments of the present exhaust system disclosed herein.

The orientation of the V-shaped intermediate baffles or vanes 84 through 88 results in the pressure pulses of the exhaust gases flowing through the intermediate chamber 59, flowing around the lateral edges of the baffles 84 through 88 and tending to cancel therebetween. The various sizes of baffles 84 through 88 results in the canceling of a relatively broad spectrum or frequency range of exhaust noise. The internal entry pipe 80, which passes through the passage 78 of the first or entry baffle 74, serves to guide the exhaust gases toward the first intermediate baffle or vane 84, with that baffle 84 dividing the gases therearound to either side thereof. The V-shape of the final or exit baffle 76, is opposite the orientation of the intermediate baffles 84 through 88 and serves to collect the exhaust energy flowing from the intermediate chamber 59 and direct it from that chamber 59 by means of the exit passage 78 therethrough (shown in FIG. 2) and internal exit pipe 82 extending therefrom.

It will be noted that many of the other various panels and components, e.g., the two internal pipes 80 and 82, may also be provided with a series of perforations or passages 94 therethrough, as shown in FIG. 2. These passages 94 serve to guide some portion of the exhaust flow into other areas of the system 10, thereby providing alternative flow paths for exhaust gases flowing through the present exhaust system 10. This further breaks up the gases and their pressure pulses, thus further attenuating such pressure pulses and the corresponding noise produced by such pressure pulses.

The present exhaust system 10 may accomplish more than merely controlling the sound level of exhaust gases passing therethrough. Present technology incorporates separate catalytic converter elements for breaking down unburned hydrocarbons and oxides of nitrogen in exhaust gases, and the present exhaust sound and emission control system embodiments may also incorporate such catalytic converter elements, e.g., elements 33 and 35, as noted further above. In addition, the present system may also incorporate internal coatings 96 of emission reduction material therein if so desired, as shown in FIG. 1, e.g., platinum, rhodium, palladium, etc.

The relatively free flow characteristics of the present exhaust system result in a relatively small percentage of the exhaust gases actually contacting the internal surfaces of the device 10 (with the exception of the catalytic converter elements 33 and 35). However, coating the internal surfaces with a catalytic conversion coating 96 as shown in FIG. 1, e.g., the internal surface of the housing 12, the separator panels 48 and 54, the entry, exit, and intermediate baffles or vanes 84 through 88, etc., nevertheless does provide some additional reduction in exhaust emissions. (Not all surfaces are shown with the coating detail, for clarity in the drawing Fig.) Moreover, the two end internal plates 28*b* and 30*b* may be made thicker to incorporate a significant amount of catalytically reactive material within their internal passages 36, and the internal construction may be modified to route substantially all of the gases through the end chambers 32 and 34 and catalytic converter elements 33 and 35, as noted further above. Thus, the present exhaust system 10 may accomplish essentially all of the required functions of exhaust treatment in a single device, i.e., muffling the overall sound level, resonating certain frequencies, and catalytically treating the exhaust emissions.

Figure 3:
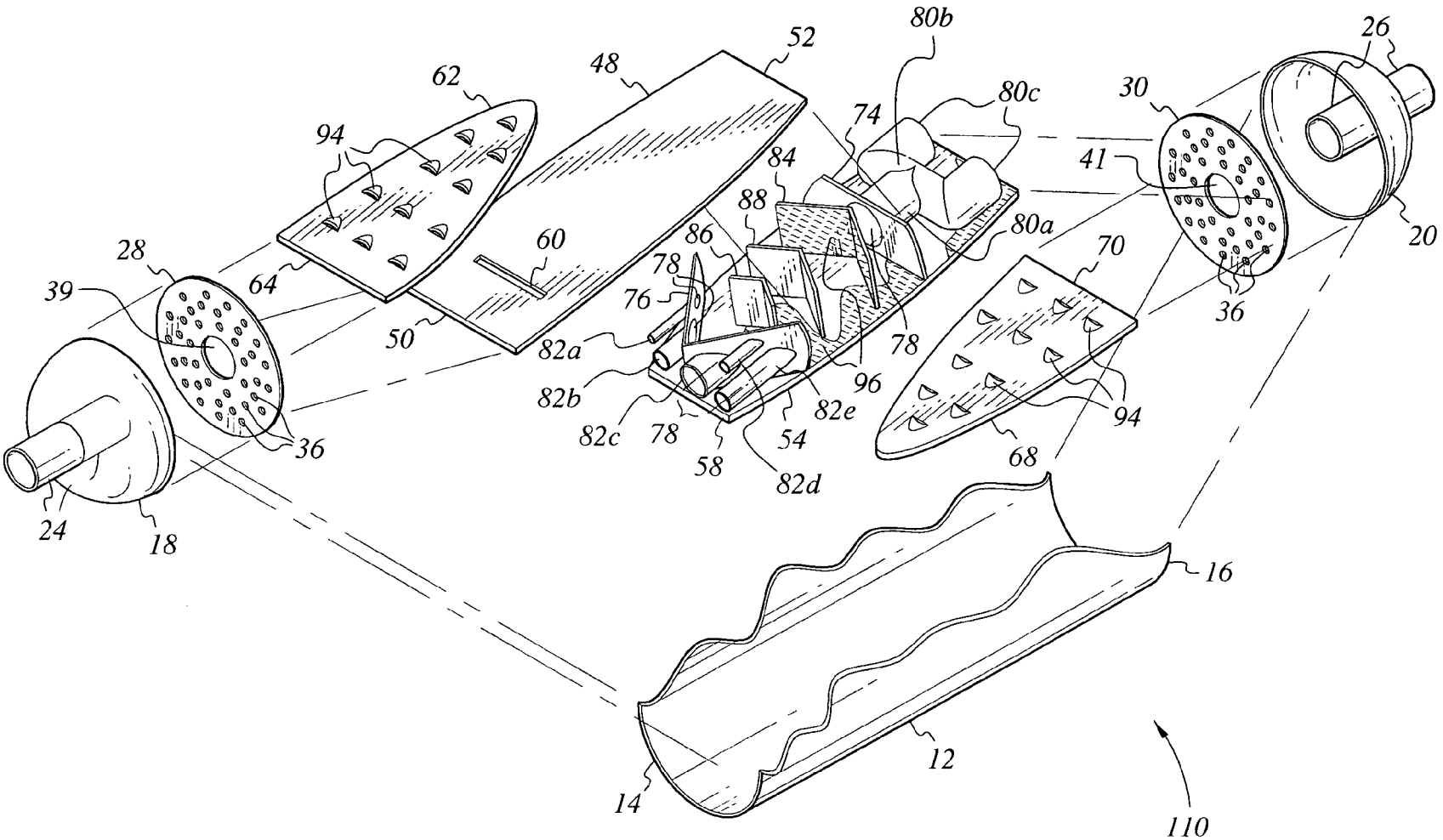
FIG. 3 is an exploded perspective view in partial section of an alternative embodiment of the single exhaust catalytic converter and resonator combination of FIG. 1, incorporating a series of resonator tubes or pipes therein.

FIG. 2 illustrates another variation that may be incorporated with the present exhaust system 10. In FIGS. 2 and 3, an additional, secondary or outer shell 98 is provided, surrounding the inner shell of the housing 12 and defining a housing volume 100 therebetween. The volume 100 therebetween may be filled with sound absorbent material 38 to quiet the present exhaust system 10 further, and/or the inner shell may be perforated, if so desired.

Figure 4:
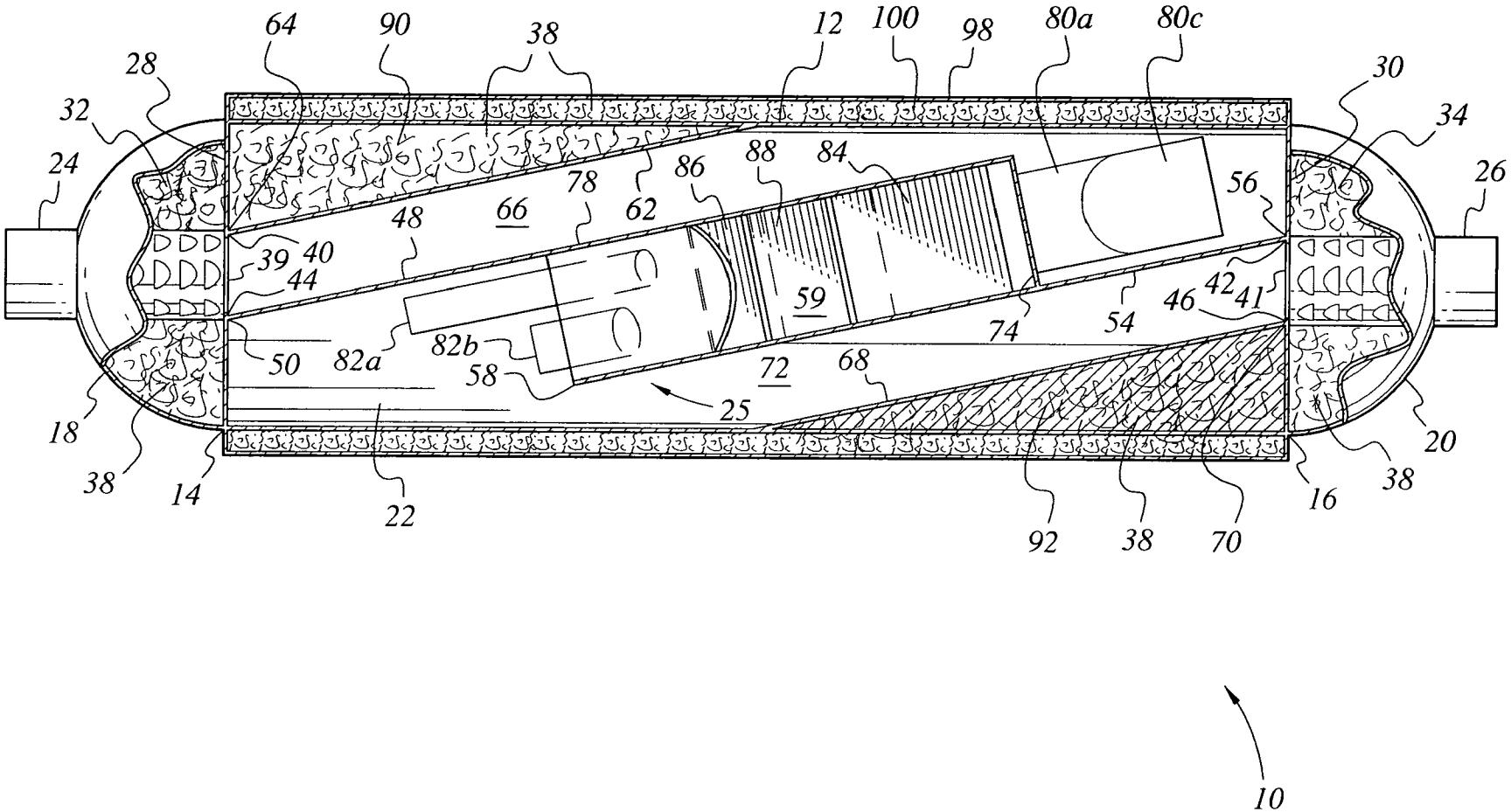
FIG. 4 is a side elevation view in section of the device of FIG. 3 showing the assembly of the components, and including further sound absorbing materials therein.

FIGS. 3 and 4 respectively provide an exploded perspective view and a side elevation view in section of another embodiment 110 of the present exhaust sound and emission control system invention. Like components between the system 10 of FIGS. 1 and 2 and the embodiment 110 of FIGS. 3 and 4 are indicated with identical reference numerals, with only those components that are different between the two embodiments being indicated by different reference numerals.

The exhaust emission and control system device 110 of FIGS. 3 and 4 comprises a generally cylindrical unit. The internal components of the exhaust system 110 are enclosed in an elongate external housing or shell 12 (shown with one side broken away in FIG. 3, for clarity in the drawing Fig.) having an inlet end 14 and opposite outlet end 16. Each end 14 and 16 of the housing 12 has an external end plate sealed thereto, respectively inlet end plate 18 and outlet end plate 20. These external end plates 18 and 20 may comprise opposed convex hemispherical shells, as shown, or may be flat or have some other shape, as desired. The additional internal volume of the illustrated convex hemispherical external end plates 18 and 20 may provide additional benefits, as discussed further below.

The external housing 12, external inlet end plate 18, and external outlet end plate 20 define an internal volume 22 (indicated in FIG. 4), which is sealed from the outer environment except for their respective inlet pipe 24 and outlet pipe 26. In the case of the hemispherical inlet and outlet plates 18 and 20, the inlet and outlet pipes 24 and 26 preferably penetrate their respective external inlet and outlet plates 18 and 20 to pass through respective inlet and outlet end chambers 32 and 34, further communicating at least indirectly with the interior volume 22 as described further below.

The central volume 22 of the exhaust system embodiment 110 includes a generally medially disposed exhaust baffle assembly 25, with exhaust gases traveling a generally sinusoidal exhaust gas path through the assembly 25, similar to the exhaust gas path arrow E shown in the embodiment 10 of FIG. 2. The extent of the internal baffle assembly 25 is defined by the overlapping portions of parallel first and second separator panels 48 and 54, discussed in detail further below.

Each of the baffle assembly end plates 28 and 30 may include a series of perforations 36 therethrough, which allow exhaust gases to circulate into the inlet and outlet end volumes 32 and 34 of the system. These end volumes 32 and 34 may include some form of sound absorbent material 38 installed therein (shown in FIG. 4, e.g., glass fiber roving, etc.) to provide additional sound control, depending upon the sound level output of the engine, the size and sound control attributes of the remainder of the system, and the sound output level and quality desired. It will also be seen that the internal end plates 28 and 30 may be made considerably longer or thicker than shown in the drawings, and with their passages or perforations 36 coated internally with a catalytically reactive material, may provide a significant catalytic conversion effect when the system is modified to provide a net exhaust flow through the end volumes 32 and 34.

While FIG. 3 illustrates the various components that comprise the present exhaust system 110, FIG. 4 provides an illustration of the exhaust gas flow paths, which pass through the system 110. For the sake of reference to the installation positions of the various internal panels, plates, and baffles comprising the internal structure of the device 110, the inlet and exhaust passages 39 and 41 of the respective baffle assembly inlet and outlet end plates 28 and 30 are considered to have a first side, respectively 40 and 42, and an opposite second side, respectively 44 and 46, indicated in FIG. 4 of the drawings. The diameter across the two sides 40, 44 of the inlet passage 39 and sides 42, 46 of the outlet passage 41, define their respective cross-sectional areas. This is an important consideration for the flow of exhaust gases to, from, and through the present system 110, as discussed further below.

A first separator panel or baffle 48 has a first end 50 that is sealed across the internal inlet plate 28, adjacent the second side 44 of the inlet passage 39. This first separator panel 48 is sloped relative to the longitudinal axis of the system 10, and extends angularly through the majority of the length of the housing 12 toward the internal wall of the housing 12, where it terminates at its second end 52. The second end 52 of the first separator panel 48 is spaced away from the internal surface of the housing 12, and defines a cross-sectional area therebetween. This cross-sectional area is in the form of a circular segment, and is at least as great as (or greater than) the cross-sectional area of the inlet pipe 24 and inlet passage 39.

A second separator panel 54 has a first end 56 that is sealed across the internal outlet plate 30, adjacent the first side 42 of the outlet pipe 26. The second separator panel 54 is also sloped relative to the longitudinal axis of the system 110, and extends angularly through the majority of the length of the housing 12 toward the internal wall of the housing 12, where it terminates at its second end 58. The two separator panels 48 and 54 are preferably substantially parallel to one another, and define an exhaust gas intermediate chamber 59 therebetween, as discussed further below. The second end 58 of the second separator panel 54 is also spaced away from the internal surface of the housing 12 and defines a cross-sectional area therebetween, essentially like the cross-sectional area between the second end 52 of the first separator panel 48 and the wall or housing 12 of the assembly 110. As in the case of the first separator panel 48, the cross-sectional area between the second end 58 of the second separator panel 54 is also at least as great as (or greater than) the cross-sectional areas of the inlet and outlet pipes 24 and 26 and inlet and outlet passages 39 and 41.

Each of the two separator panels 48 and 54 may include a lateral exhaust gas pressure balance passage 60, which extends thereacross and near the respective first ends 50 and 56 of the two panels 48 and 54. These two pressure balance passages 60 provide alternative exhaust gas passages through the interior 22 of the system 110, with pressure pulses on each side of the panels 48 and 54 tending to cancel one another through the balance passages 60.

A first supplementary panel 62 has a first end 64 which is sealed across the internal surface of the inlet end plate 18 (or to its associated internal plate 28) adjacent the first side 40 of the inlet pipe 24, and extends angularly through substantially the first half of the length of the system 110. The outer edge of the supplementary panel 62 forms a parabolic curve, in keeping with its juncture with the cylindrical internal surface of the housing 12. It will be seen that the supplementary panel 62 may have any suitable peripheral shape adapted to mate closely with and seal along the internal surface of the housing 12, depending upon the shape of the housing 12. The first supplementary panel 62 is preferably parallel to the first separator panel 48, and along with the housing 12 walls, defines an exhaust gas inlet chamber 66 therebetween, as shown in the side elevation in section of FIG. 4.

A second supplementary panel 68 has a first end 70 sealed across the internal surface of the outlet end plate 20, or to its associated internal plate 30, adjacent the second side 46 of the outlet pipe 26, and extends angularly through substantially the second half of the length of the system 110. The outer edge of the second supplementary panel 68 is also sealed along the internal wall of the housing or shell 12, similarly to the first supplementary panel 62. The second supplementary panel 68 is preferably parallel to the second separator panel 54, and along with the housing 12 walls, defines an exhaust gas outlet chamber 72 therebetween.

The above described layout of the various panels or baffles 48, 54, 62, and 68 results in the inlet chamber 66, intermediate chamber 59, and outlet chamber 72 communicating with one another sequentially, as the exhaust gases flow from the inlet pipe 24 into the inlet chamber 66, through the gap between the second end 52 of the first separator panel 48 and the housing 12, back through the intermediate chamber 59, then through the gap between the second end 58 of the second separator panel 54 and the housing 12, through the outlet chamber 72, and finally out the outlet pipe 26. This sinusoidal primary exhaust gas pathway is at least two and one half times the external length of the system 10, due to the lengths of the two separator panels 48 and 54 extending within the housing 12 for some three quarters of the length of the housing 12, along with the additional internal entry and exit pipes (discussed further below) for the intermediate passage area 59.

The intermediate chamber 59 further includes a series of generally lateral baffles or vanes thereacross, which serve to further attenuate the sound of the exhaust as it passes through the present system 110. Intermediate chamber entry and exit baffles, respectively 74 and 76, extend laterally across the entry and exit ends of the intermediate passage area 59. These baffles extend completely across the interior of the housing 12, extending from the second end 52 of the first separator panel 48 to the second separator panel 54 (for the entry baffle 74) and from the second end 58 of the second separator panel 54 to the first separator panel 48 (for the exit baffle 76), normal to the two panels 48 and 54.

These two baffles 74 and 76 seal the intermediate passage area 59, with the exception of their passages 78 through which all exhaust gases must pass to travel into and from the intermediate chamber 59. Each internal baffle passage 78 may include one or more supplementary pipes or resonator tubes extending therefrom. In the example of FIGS. 3 and 4, the entry baffle 74 has a single internal entry pipe or tube 80*a* extending therefrom and toward the outlet end 16 of the system 10, with a lateral tube or pipe 80*b* (shown in FIG. 3) extending therefrom. A pair of opposed branch tubes or pipes 80*c* extend from the ends of the lateral pipe 80*b*. The opposite exit baffle 76 includes a series of exit pipes or tubes 82*a* through 82*e* extending therefrom and toward the inlet end 14 of the system 10. The exit pipes or tubes 82*a* through 82*e* may be of various lengths, diameters, cross sectional shapes, and locations from the exit baffle 76, depending upon the precise frequencies which must be attenuated by the resonator properties of the tubes. These two internal pipe or tube assemblies 80 and 82 add some additional length to the intermediate chamber 59 for further tuning effect, and serve to duct and guide the exhaust gases into and from the intermediate chamber 59.

The intermediate chamber 59 further includes a series of generally chevron-shaped intermediate baffles or vanes extending between the two separator panels 48 and 54, and installed between the intermediate chamber entry and exit baffles 74 and 76. These baffles or vanes extend from a relatively wider first intermediate baffle 84 to a relatively narrower last intermediate baffle 86, with one or more secondary intermediate baffles 88 disposed therebetween. Each of these intermediate baffles 84 through 88 is oriented with the apex of the V facing the intermediate chamber entry baffle 74, and extends between the two separator panels 48 and 54. However, some lateral space is provided for exhaust gas flow around the ends of the intermediate baffles 84 through 88, with each of the baffles 84 through 88 having a narrower width from the entry baffle 74 toward the opposite exit baffle 76.

The orientation of the V-shaped intermediate baffles or vanes 84 through 88 results in the pressure pulses of the exhaust gases flowing through the intermediate chamber 59, flowing around the lateral edges of the baffles 84 through 88 and tending to cancel therebetween. The various sizes of baffles 84 through 88 results in the canceling of a relatively broad spectrum or frequency range of exhaust noise. The internal entry pipe 80*a*, which passes through the passage 78 of the first or entry baffle 74, serves to guide the exhaust gases toward the first intermediate baffle or vane 84, with that baffle 84 dividing the gases therearound to either side thereof. The V-shape of the final or exit baffle 76, is opposite the orientation of the intermediate baffles 84 through 88 and serves to collect the exhaust energy flowing from the intermediate chamber 59 and direct it from that chamber 59 by means of the exit passage 78 therethrough (shown in FIG. 4) and internal exit pipe 82 extending therefrom.

It will be noted that the two supplementary panels 62 and 68, along with the adjacent areas of the external housing 12, define first and second supplementary volumes 90 and 92 in the device 110. The two supplementary panels 62 and 68 are provided with a series of perforations or passages 94 therethrough, which allow the pressure pulses of the exhaust gases to flow into the supplementary volumes 90 and 92, at least to some extent. This provides further frequency cancellation of exhaust noises and sounds in the present exhaust system 110. These passages 94 may be in the form of semicircular arcs, as shown, or some alternative shape as desired.

It will be noted that many of the other various panels and components, e.g., the two internal pipe assemblies 80 and 82, may also be provided with a series of perforations or passages 94 therethrough, as shown in FIG. 2. These passages 94 serve to guide some portion of the exhaust flow into other areas of the system 110, thereby providing alternative flow paths for exhaust gases flowing through the present exhaust system 110. This further breaks up the gases and their pressure pulses, thus further attenuating such pressure pulses and the corresponding noise produced by such pressure pulses.

It will be seen that the present exhaust sound and emission control system 110 may also incorporate such catalytic converter elements, e.g., elements 33 and 35, as shown in the embodiment 10 of FIGS. 1 and 2 and described further above. In addition, the present system 110 may also incorporate internal coatings 96 of emission reduction material therein if so desired, as shown in FIG. 3, e.g., platinum, rhodium, palladium, etc.

The relatively free flow characteristics of the present exhaust system result in a relatively small percentage of the exhaust gases actually contacting the internal surfaces of the device 110 (with the exception of the catalytic converter elements 33 and 35, if incorporated therewith). However, coating the internal surfaces with a catalytic conversion coating 96 as shown in FIG. 3, e.g., the internal surface of the housing 12, the separator panels 48 and 54, the entry, exit, and intermediate baffles or vanes 84 through 88, etc., nevertheless does provide some additional reduction in exhaust emissions. (Not all surfaces are shown with the coating detail, for clarity in the drawing.) Moreover, the two end internal plates 28 and 30 may be made thicker to incorporate a significant amount of catalytically reactive material within their internal passages 36, and the internal construction may be modified to route substantially all of the gases through the end chambers 32 and 34 and catalytic converter elements 33 and 35, as noted further above. Thus, the present exhaust system 110 may accomplish essentially all of the required functions of exhaust treatment in a single device, i.e., muffling the overall sound level, resonating certain frequencies, and catalytically treating the exhaust emissions.

FIG. 4 illustrates another variation that may be incorporated with the present exhaust system 110. In FIG. 4, an additional, secondary or outer shell 98 is provided, surrounding the inner shell of the housing 12 and defining a housing volume 100 therebetween. The volume 100 therebetween may be filled with sound absorbent material 38 to quiet the present exhaust system 10 further, and/or the inner shell may be perforated, if so desired.

Figure 5:
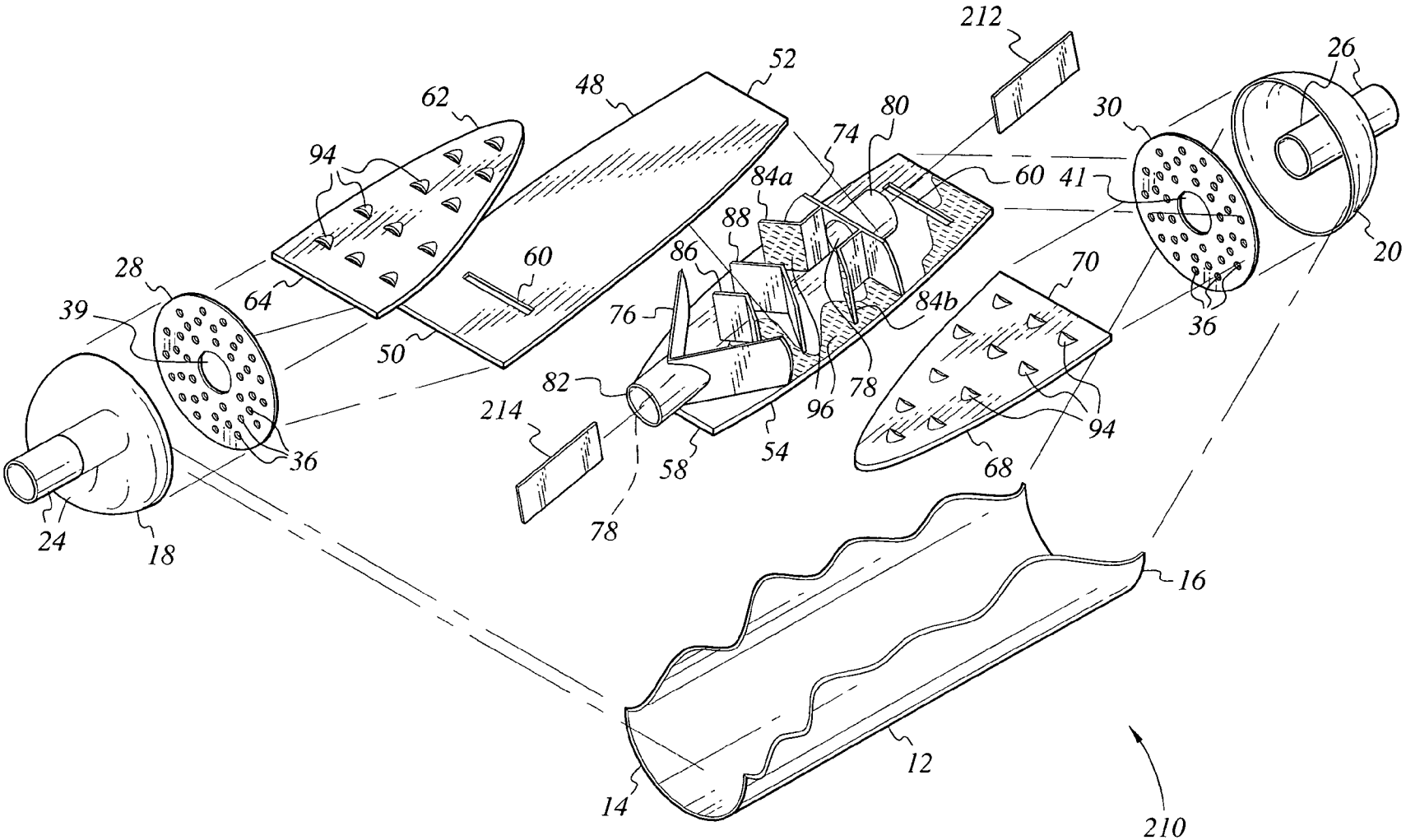
FIG. 5 is an exploded perspective view in partial section of a further alternative embodiment of the device of FIG. 1, incorporating an alternative internal baffle configuration.
Figure 6:
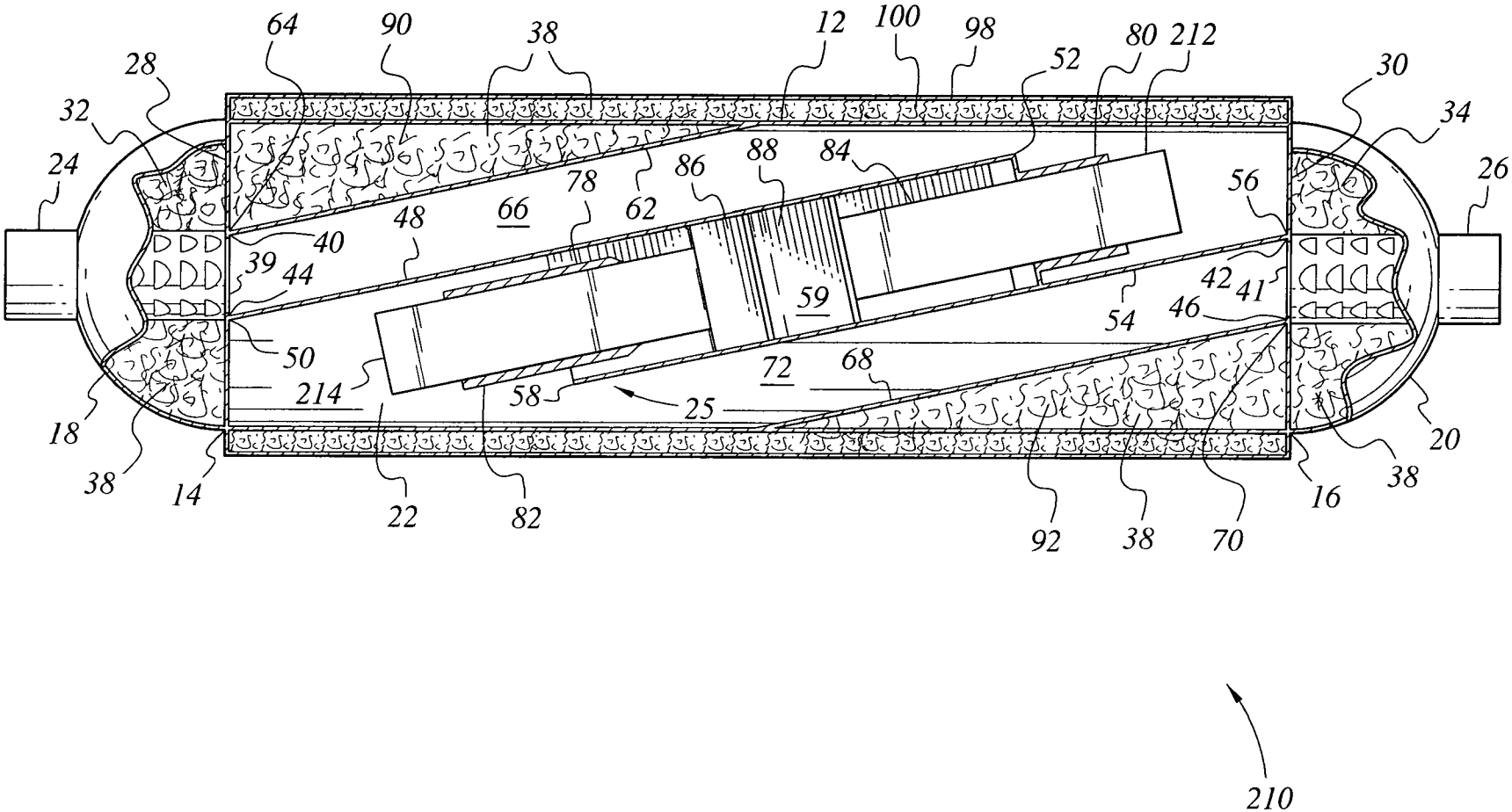
FIG. 6 is a side elevation view in section of the device of FIG. 5 showing the assembly of the components, and including further sound absorbing materials therein.

FIGS. 5 and 6 respectively provide an exploded perspective view and a side elevation view in section of yet another embodiment 210 of the present exhaust sound and emission control system invention. Like components between the system 10 of FIGS. 1 and 2 and the system 210 of FIGS. 5 and 6 are indicated with identical reference numerals, with only those components that are different between the two embodiments being indicated by different reference numerals. Those like components need not be described in detail for the embodiment 210 of FIGS. 5 and 6. Generally, the embodiment 210 is related to the embodiment 110 of FIGS. 3 and 4, in that the embodiment 210 does not include additional catalytic converter elements 33 and 35 (although they could be installed in the embodiment 210, if so desired).

The embodiment 210 differs from the embodiment 110 in the areas of the internal chamber entry and exit baffles or upstream and downstream guides 74 and 76, and the second upstream baffle or guide. It will be seen in FIGS. 5 and 6 that the second upstream baffle or guide is actually formed as two separate sides or components 84*a* and 84*b*, with each component being on an opposite side of the resonator tube passage 78 through the entry baffle or guide 74. The two baffle or guide components 84*a* and 84*b* may extend upstream and join to the entry baffle or guide 74, to each side of the exhaust resonator tube passage 78 therethrough, as indicated by the broken line portions of each baffle component 84*a* and 84*b*. Alternatively, the baffle components 84*a* and 84*b* may be separated from the entry baffle or guide 74, if the broken line portions of each baffle component 84*a* and 84*b* are removed.

Moreover, an upstream and a downstream divider vane, respectively 212 and 214, are installed through the respective entry and exit pipes or tubes 80 and 82 in the embodiment 210 of FIGS. 5 and 6. These divider vanes 212 and 214 have lengths approximately equal to their respective tubes 80 and 82, and serve to smooth and separate the exhaust gas flow relative to the two sides of the series of chevron shaped baffles or guides 76, 86, and 88. Accordingly, the upstream divider vane 212 may extend between the two sides of the separate guide components 84*a* and 84*b* to the secondary intermediate baffle or guide 88, to preclude turbulent flow due to gases passing from one side of the assembly to the other.

Figure 7:
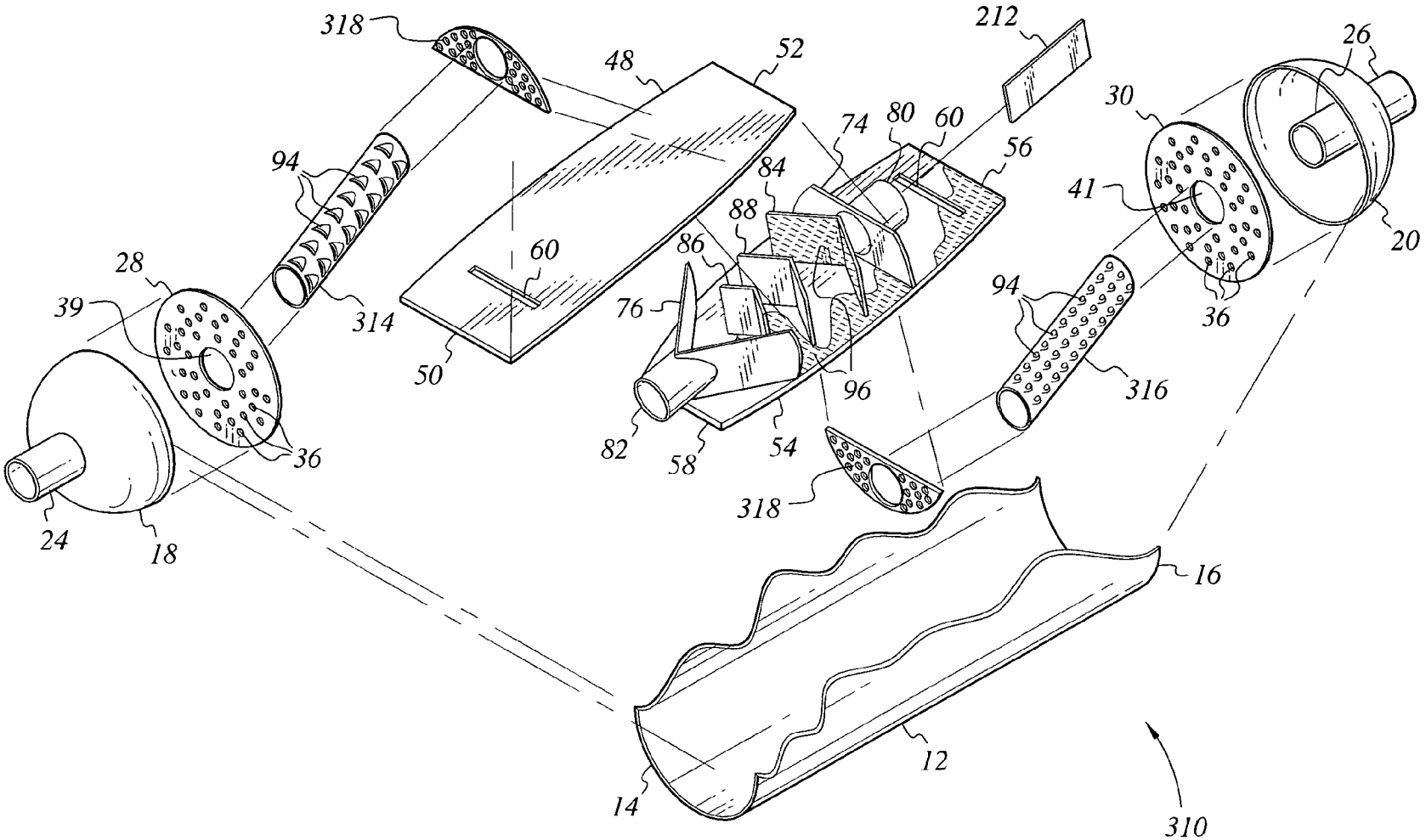
FIG. 7 is an exploded perspective view in partial section of a further alternative embodiment of the device of FIG. 1, incorporating an alternative internal flow tube configuration.
Figure 8:
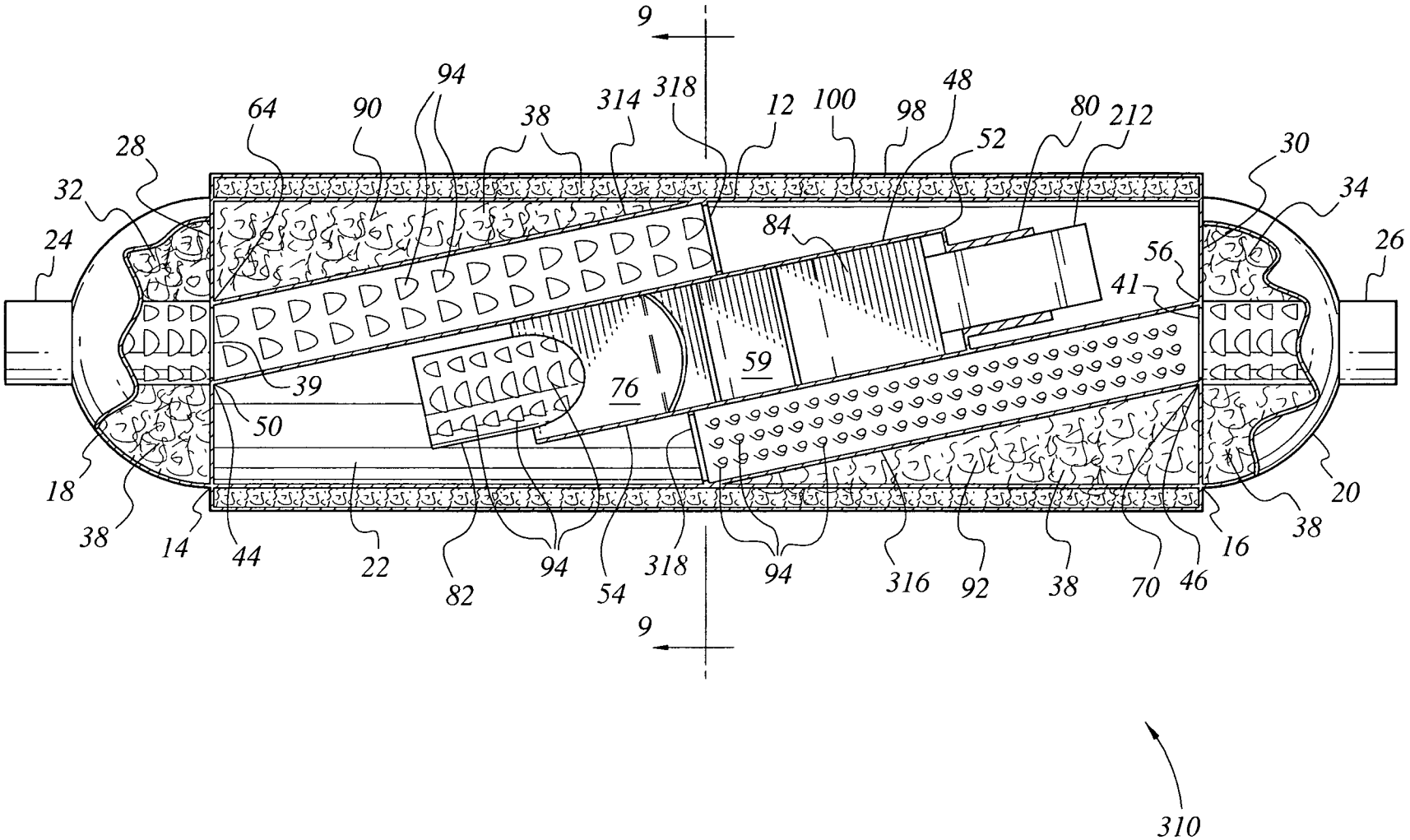
FIG. 8 is a side elevation view in section of the device of FIG. 7 showing the assembly of the components, and including further sound absorbing materials therein.
Figure 9:
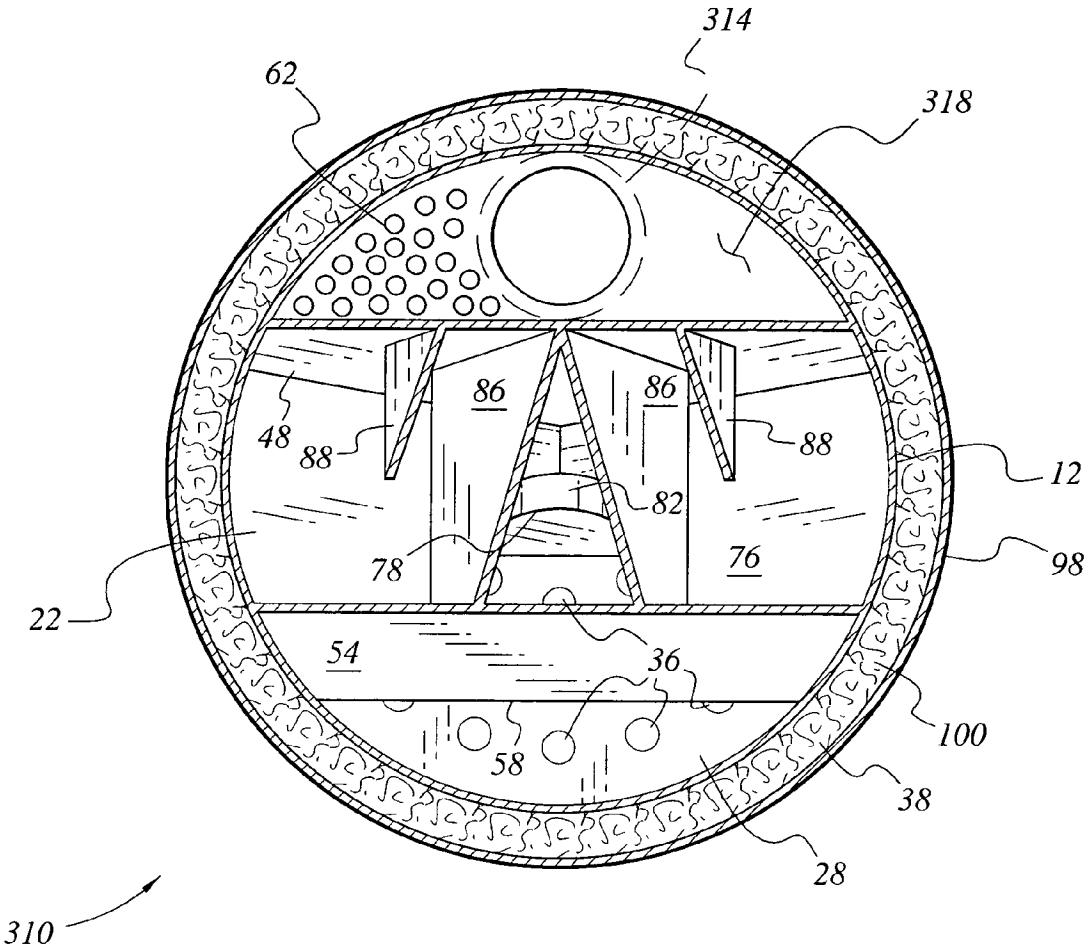
FIG. 9 is an end elevation view in section through line 9-9 of FIG. 8, showing further details of the relationship of the internal components of the device.

FIGS. 7 through 9 respectively provide an exploded perspective view, a side elevation view in section, and a lateral view in section through line 9-9 of FIG. 8, of yet another embodiment 310 of the present exhaust sound and emission control system invention. Like components between the system 10 of FIGS. 1 and 2 and the system 310 of FIGS. 7 through 9 (and other embodiments) are indicated with identical reference numerals, with only those components that are different between the different embodiments being indicated by different reference numerals. As in the case of the embodiment 210 of FIGS. 5 and 6, those like components need not be described in detail for the embodiment 310 of FIGS. 7 through 9. Generally, the embodiment 210 is related to the embodiment 110 of FIGS. 3 and 4, in that the embodiment 310 does not include additional catalytic converter elements 33 and 35 (although they could be installed in the embodiment 310, if so desired).

The embodiment 310 differs from other embodiments, particularly the embodiment 210 of FIGS. 5 and 6, in the volumes of the exhaust gas inlet and outlet chambers 66 and 74 and first and second supplementary volumes 90 and 92 of the embodiment 210. In the embodiment 310, inlet and outlet volume tubes, respectively 314 and 316, extend from their respective openings or passages 39 and 41 through the inlet and outlet end plates 28 and 30, adjacent and parallel to the two separator panels 48 and 54. These tubes 314 and 316 serve to guide the exhaust gas flow into the system 310, and include perforations, louvers, and/or other lateral passages 94 therethrough, through which the exhaust gases pass to enter the interior volume of the system 310. A semicircular (or other congruent shape) end plate 318 is installed between the inner shell or housing 12 and the corresponding separator panel 48 or 54 and across the end of the respective tube 314 or 316, to support the ends of the tubes 314 and 316. These end plates 318 may be solid (excepting the flow through passage for each tube 314 and 316), or may be foraminous, as is optionally provided in various other internal components of the present exhaust system embodiments. (Only one side of the plate 318 is shown with perforations in FIG. 9, to show the two alternatives.)

Figure 10:
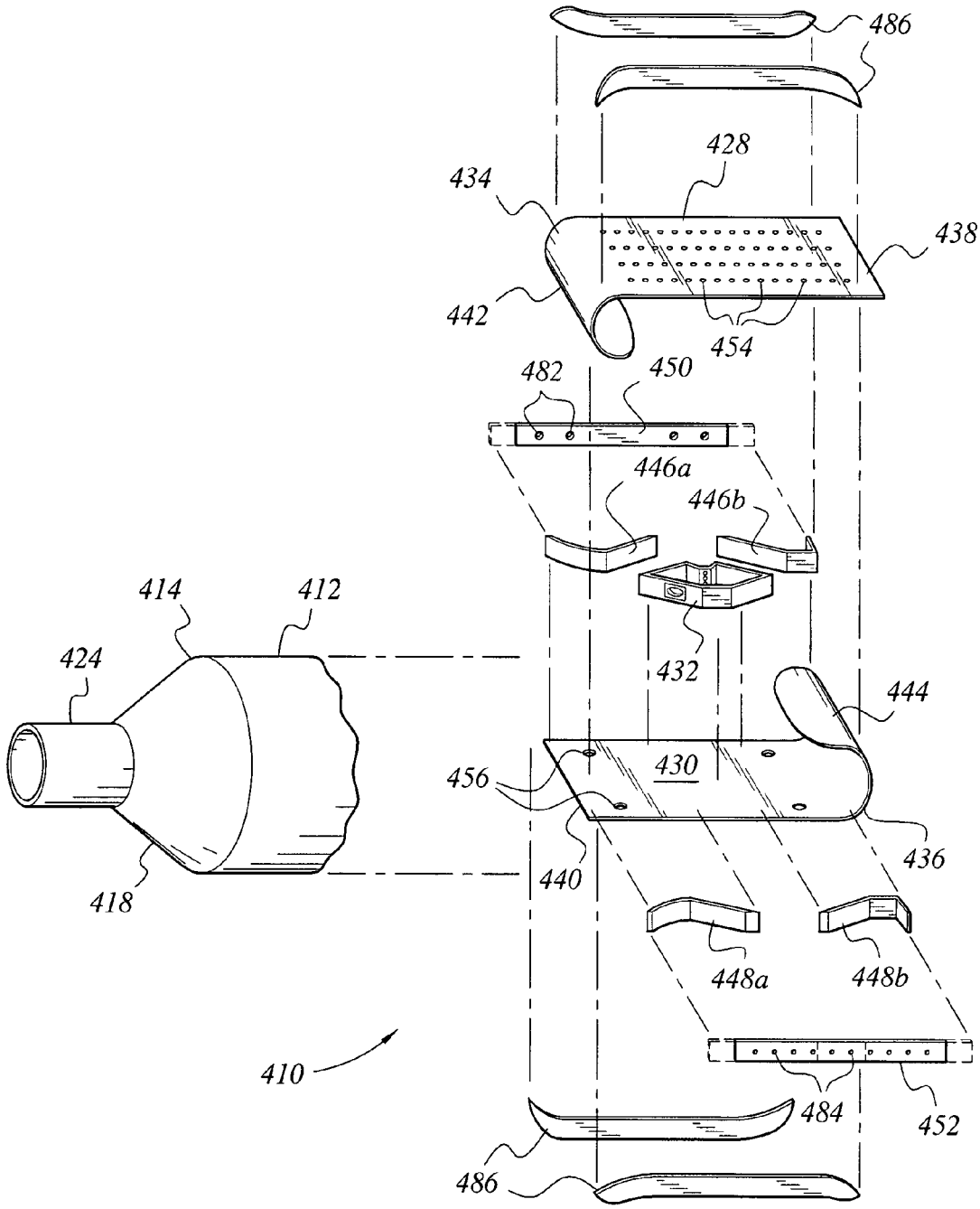
FIG. 10 is an exploded perspective view of an alternative configuration incorporating a three-legged sinusoidal primary flow path with a generally rhomboid central flow divider.
Figure 11:
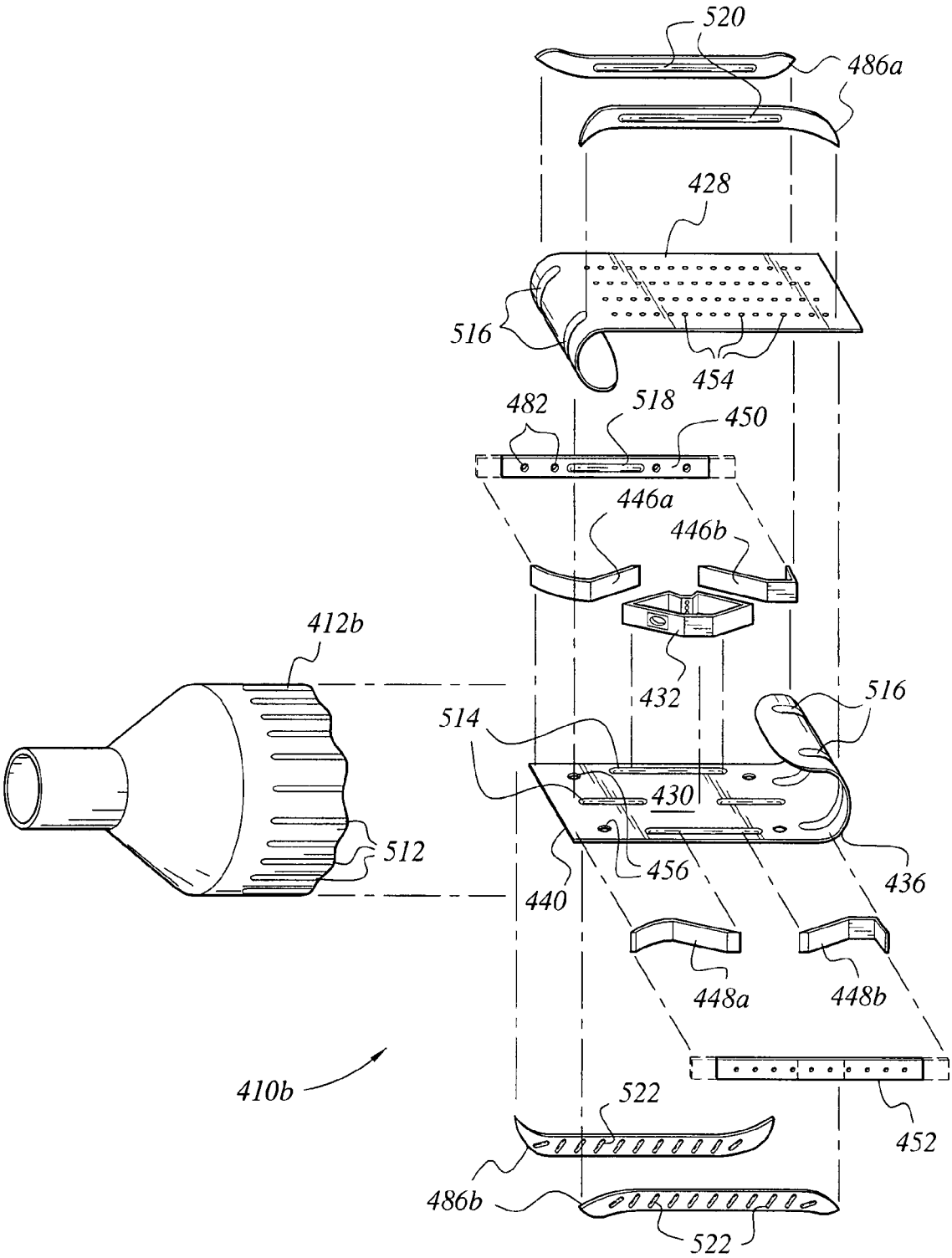
FIG. 11 is an exploded perspective view of an alternative embodiment of the device of FIG. 10, incorporating additional stiffening ribs disposed in various panels and components thereof.
Figure 12:
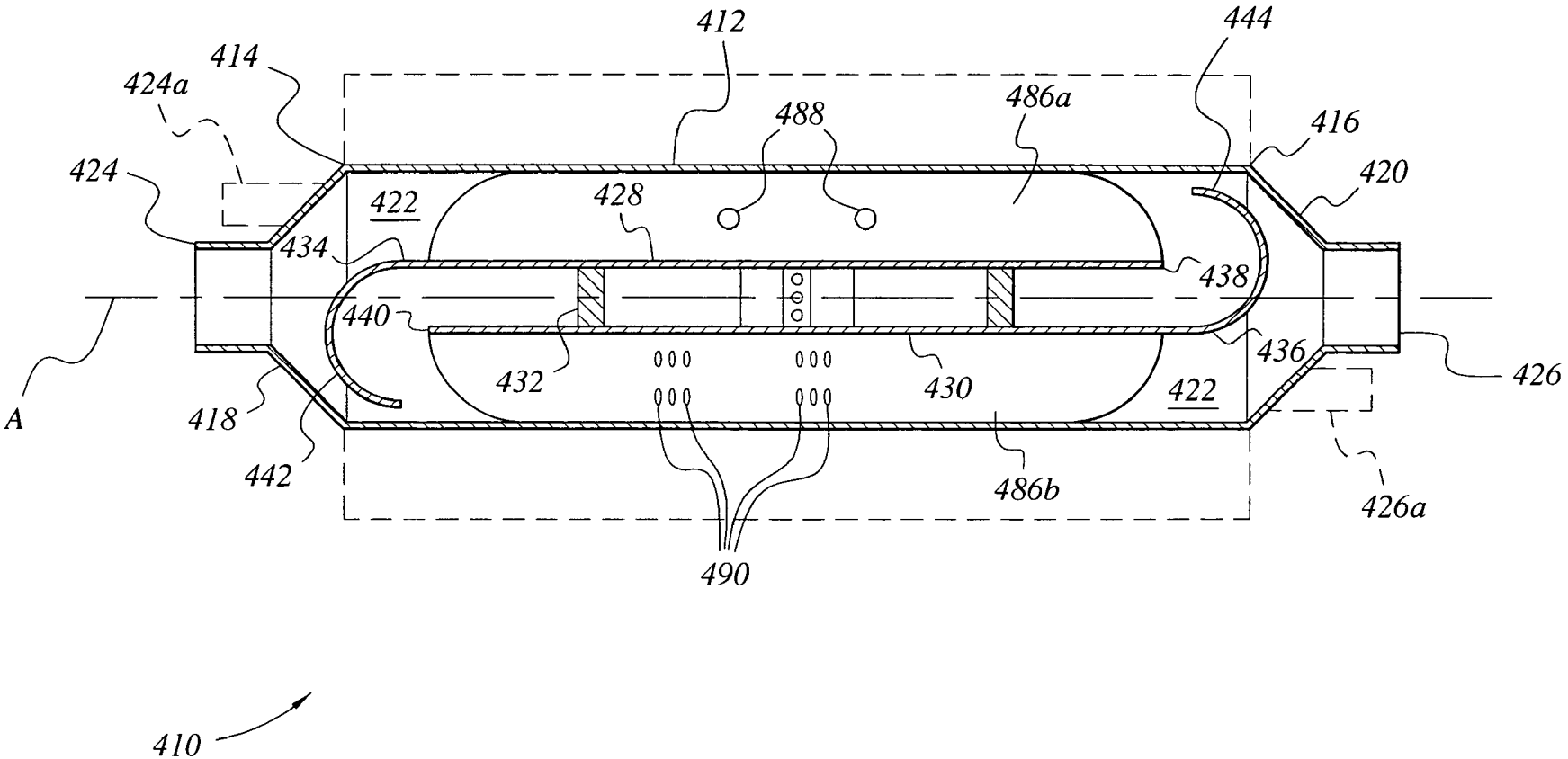
FIG. 12 is a side elevation view in section of the exhaust system device of FIG. 10, showing further details thereof.
Figure 13:
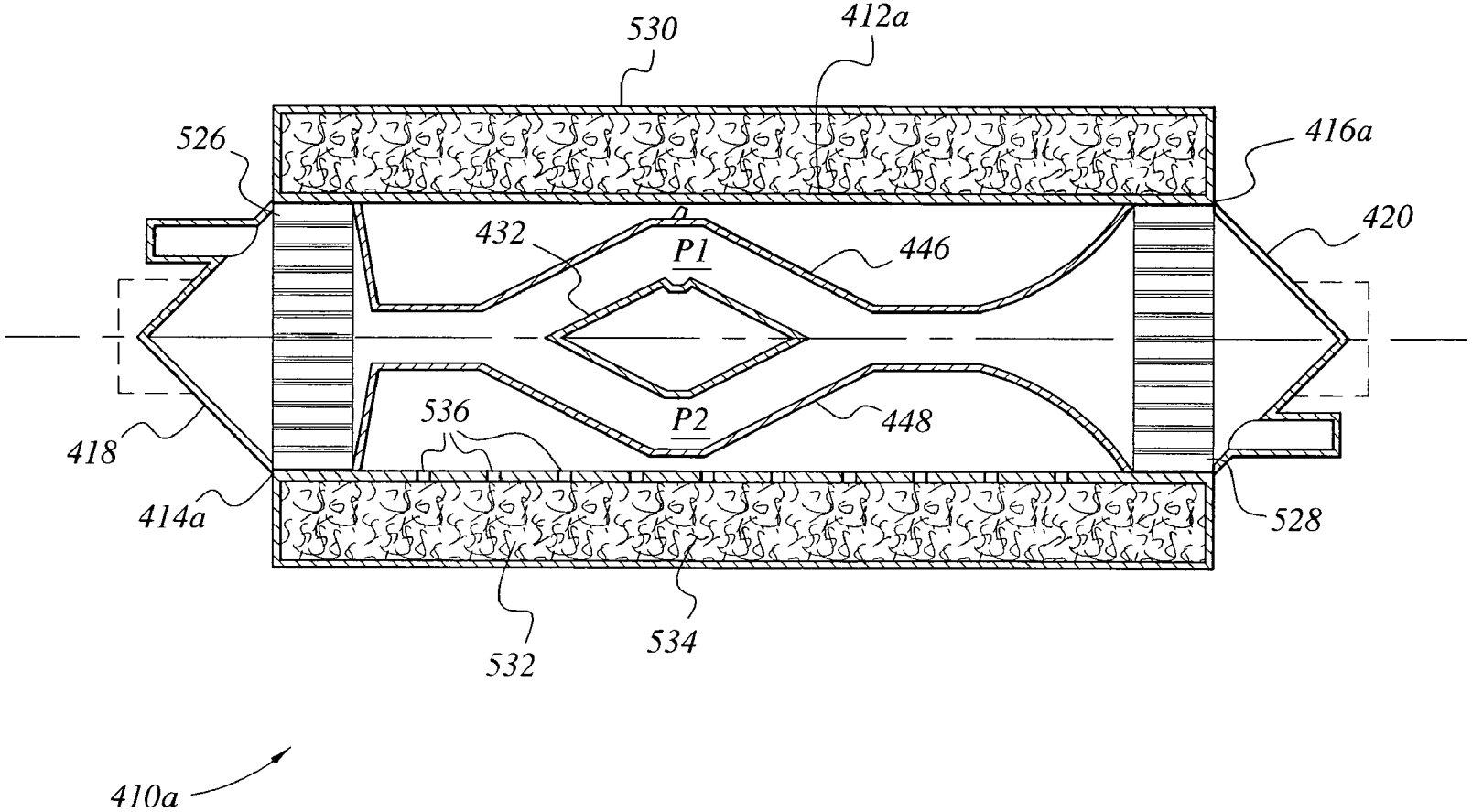
FIG. 13 is a top plan view in section of an alternative embodiment of the device of FIG. 10, illustrating the rhomboid central flow divider and alternative surrounding sound attenuation chamber.

FIGS. 10 through 20 illustrate further closely related embodiments of the exhaust sound and emission control system. FIGS. 10 and 12 illustrate an exhaust device 410, with FIGS. 11 and 13 illustrating variations of the device 410 of FIGS. 10 and 12. The exhaust device 410 of FIGS. 10 and 12 includes a housing or shell 412 having a first end 414, a second end 416 opposite the first end, and an elongate major axis A. Each of the housing ends is sealed by an end cover, respectively, the first end cover 418 and opposite second end cover 420, to define an interior volume 422 within the housing or shell 412. Each of the two end covers 418 and 420 may comprise a conical configuration, as shown in the drawings, or may alternatively be a flat plate, hemispherical shape, or other regular or irregular geometric shape or configuration as desired. A first end pipe 424 penetrates and extends from the first end cover 418, with an opposite second end pipe 426 penetrating and extending from the second end cover 420 to communicate with the interior volume 422 and allow exhaust gas flow through the device. The end pipes may be concentric with the axis A of the device, as shown in solid lines in FIG. 12, or may alternatively be axially offset, as shown by the alternative first and second end pipes 424*a* and 426*a* in broken lines in FIG. 12. The various first and second end components are described in this manner, rather than as exhaust entry and exit end components, as the exhaust device 410 is substantially symmetrical in its flow characteristics and may be installed with either the first or second end as the exhaust gas entry end, as desired.

The housing or shell 412 contains a first and a second separator plate, respectively 428 and 430, therein. These two plates extend laterally to join with the internal wall of the housing 412, and are disposed parallel to the major axis A and to one another. The two separator plates 428 and 430 are spaced apart from one another, with a flow divider 432 captured therebetween. The flow divider preferably comprises a generally rhomboid shape when viewed from above or below as shown in FIG. 13, and serves to define mutually separate first and second primary exhaust gas flow paths, respectively P1 and P2, through the housing and between the two separator plates, along with additional lateral flow guides discussed further below. These two flow paths P1 and P2 are most clearly shown in the alternate embodiment of FIG. 13, but this internal flow path configuration is essentially the same in all of the embodiments of FIG. 10 through 20.

Each of the separator plates 428 and 430 includes a first end, respectively 434 and 436, and an opposite second end, respectively 438 and 440. The first ends 434, 436 of the two separator plates are described as being positioned toward the opposite ends of the housing 412 from one another, as are the corresponding second separator plate ends 438 and 440. First and second arcuate flow guides, respectively 442 and 444, extend from the respective first ends 434 and 436 of the two separator plates, and curve around the adjacent second separator plate ends. Thus, the second end 438 of the first separator plate 428 forms the origin of the radius of curvature of the second arcuate flow guide 444, with the second end 440 of the second separator plate 430 forming the origin of the radius of curvature of the first arcuate flow guide 442, as shown most clearly in the side elevation view in section of FIG. 12.

In this manner, exhaust gas entering the first end 414 of the housing shell 412 follows at least a generally sinusoidal path through the system. The exhaust gas travels at least generally between the upper portion of the housing 412 and the first separator plate 428 until it reaches the second arcuate flow guide 444, which causes the flow to double back 180 degrees to flow between the two separator plates 428 and 430 and to separate into flow paths P1 and P2 around the rhomboid flow divider 432 (as shown in FIG. 13). The exhaust gas then reaches the first arcuate flow guide 442, whereupon it is forced to double back 180 degrees to travel between the second separator plate 430 and the lower portion of the housing or shell 412 to exit the second end 416 of the housing. It will be seen that if the second end pipe 426 (or 426*a*) is used as the exhaust gas entry point for the device, that the above described flow path is reversed.

It will be noted in FIG. 12 that slight gaps are provided between the distal edges of the two arcuate flow guides 442 and 444 and the internal surface of the housing or shell 412. This is intentional in certain embodiments, to allow some portion of the exhaust gases to bypass the sinusoidal path and to have a more direct flow. The different pressure pulses and internal pressures developed by such multiple flow paths has been found to be advantageous in canceling certain frequencies of exhaust sounds. Alternatively, the curvatures of the two arcuate flow guides 442, 444 may be adjusted to meet the inner surface of the housing 412, to force essentially all of the exhaust gases to flow through the sinusoidal path defined by the two separator plates 428 and 430, their arcuate flow guides 442 and 444, and the housing or shell 412.

Figure 14:
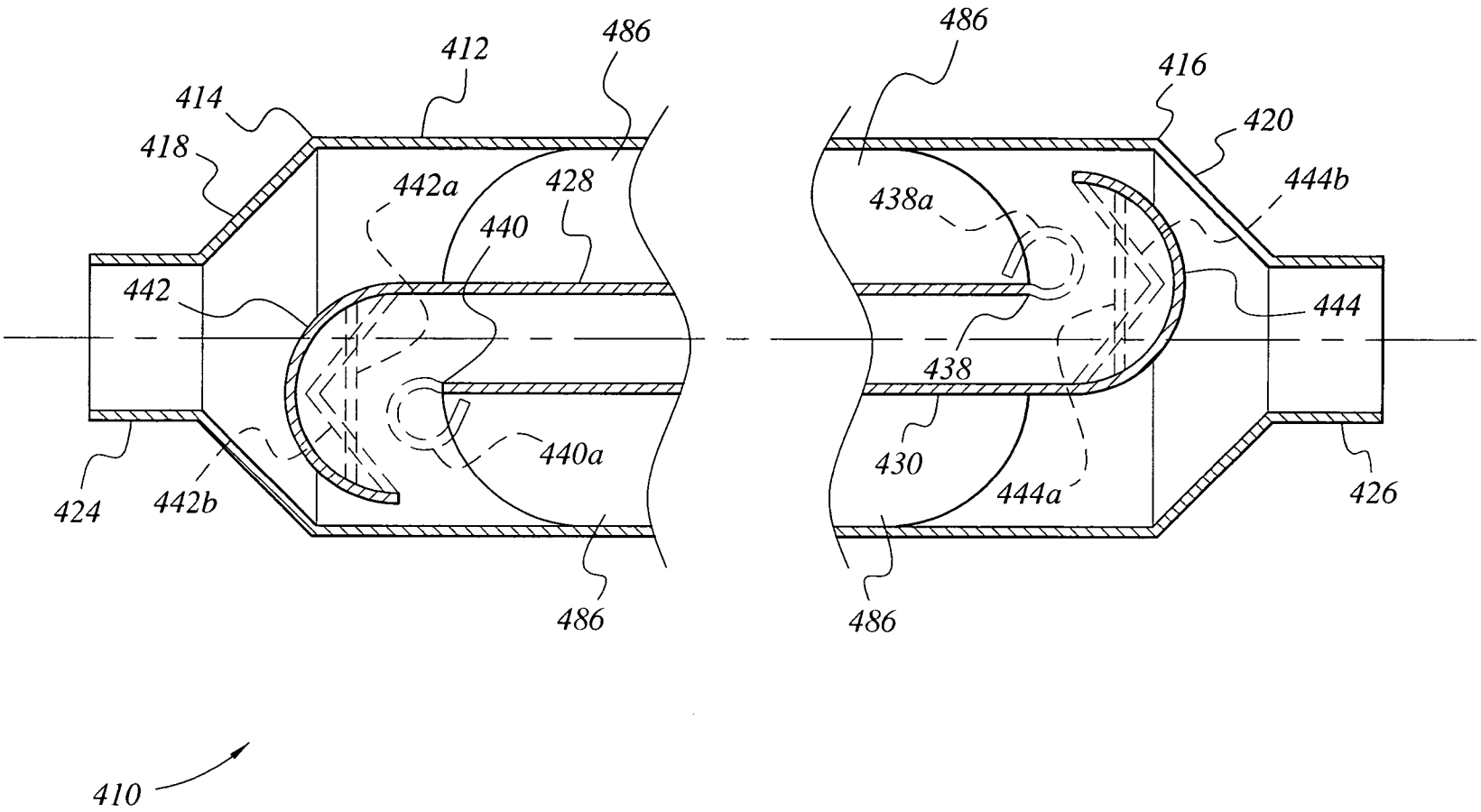
FIG. 14 is a side elevation view in section of the device of FIG. 10, showing various alternative configurations for the gas flow guides at the ends of the legs of the sinusoidal flow path.
Figure 15:
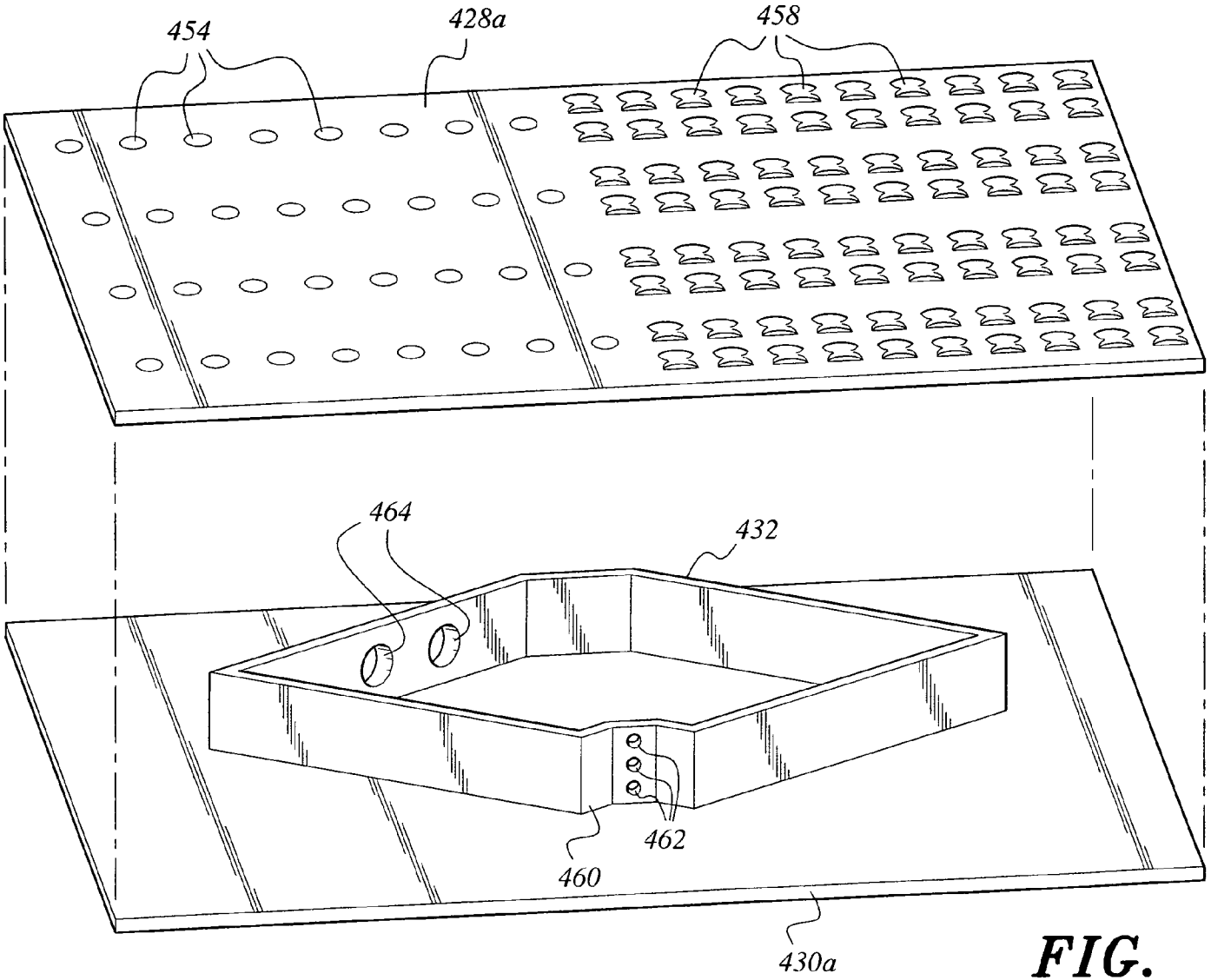
FIG. 15 is a detailed exploded perspective view of the central leg of the sinusoidal flow path, illustrating the rhomboid flow divider and two embodiments of the plates between which the flow divider is captured.

The structure provided to turn the exhaust gas flow through 180 degrees at the ends of the two separator plates may be adjusted as desired. FIG. 14 illustrates various alternative configurations of the separator plate ends and flow guides. While the two separator plates 428 and 430 have arcuate first and second flow guides 442 and 444 shown in solid lines in FIG. 14, various alternative flow guide shapes are shown in broken lines. For example, flat plate guides 442*a*, 442*b* substantially normal to the planes of the two separator plates 428 and 430 may be provided if so desired, or alternatively the flow guides may comprise chevron shaped components 442*b*, 444*b*. Another alternative is the formation of a large radius lip or edge for the second ends 438*a* and 440*a* of the two separator plates, in order to provide smoother gas flow around the edge and avoid separation which would likely occur when the gases flow around a relatively sharp edge. Such a large radius second end lip 438*a*, 440*a* works particularly well when combined with the arcuate flow guides 442 and 444.

More precise control of the exhaust gas flow through the two flow paths P1 and P2 may be achieved by providing lateral flow guides between the two separator plates 428 and 430, to form first and second exhaust gas flow paths P1 and P2 of substantially constant and equal cross sectional areas. FIG. 10 illustrates these lateral flow guide assemblies in an exploded perspective view, while the alternative embodiment of FIG. 13 shows the lateral flow guides in a plan view in section of the completed alternative structure 410*a*. First and second lateral guides, respectively 446 and 448, extend from (or nearly from) the first end 414*a* to (or nearly to) the opposite second end 416*a* of the housing or shell 412*a*, in the embodiment 410*a* of FIG. 13. These two lateral guides 446 and 448 are formed or configured to narrow from maximum width essentially equal to the width of the first end 414*a*, to define relatively narrow but constant width and cross sectional area flow paths P1 and P2 about the rhomboid flow divider 432 (along with the two parallel separator plates 428 and 430), with the two guides then diverging to meet the inner surface of the housing 412*a* at its second end 416*a*.

The lateral flow guides illustrated in the FIG. 10 and 11 embodiments differ from the lateral guides 446 and 448 of the embodiment of FIG. 13, in that the FIG. 10 and 11 guides are formed as multiple sections or pieces. The first lateral flow guide of the embodiments of FIGS. 10 and 11 comprises a first section 446*a* and a second section 446*b*, with the two sections being disposed toward opposite ends of the exhaust device assembly. The two sections 446*a*, 446*b* are discontinuous, with a first straight lateral fence 450 extending between the lateral edges of the two separator plates 428 and 430 to form the medial portion of the first lateral flow guide assembly. The opposite second lateral flow guide assembly is essentially a mirror image of the first assembly, comprising first and second sections 448*a* and 448*b* with the medial portion being formed by the second straight lateral fence 452. The two lateral flow fences 450 and 452 may be adjusted in length as desired or required, as shown by the broken line end portions thereof indicated in FIGS. 10 and 11.

The primary exhaust gas flow through the exhaust device embodiments of FIGS. 10 through 20 is via the sinusoidal path between the two separator plates 428 and 430 and the housing or shell 412, as described further above. However, various amounts or portions of the exhaust gas flow may be allowed to divert or diffuse through other portions of the device by means of appropriate diffuser passages, if so desired. For example, the first and second separator plates 428 and 430, shown in FIGS. 10 and 11, are provided with a series of exhaust gas diffuser holes or passages therethrough. The first separator plate 428 contains a relatively large number of relatively small passages 454 therethrough, while the second separator plate contains only a few relatively larger holes 456. It will be understood that the exhaust gas may be required to flow through the complete sinusoidal path by forming the two separator plates as solid, continuous units without any holes or perforations therethrough, as in the separator plate example 430*a* shown in FIG. 15. Alternatively, either or both separator plates may include a combination of different diffuser passage configurations, as shown in the alternative first separator plate 428*a* of FIG. 15, in which the separator plate 428*a* includes both a series of relatively small passages 454 in a portion thereof and a series of louvers 458 in another portion thereof. These various passages 454, 456, and/or 458 may be applied to either or both of the two separator plates, and/or other internal components, as desired in order to achieve the desired sound attenuation characteristics for the device.

The rhomboid flow divider 432 may also include one or more diffuser passages therethrough, if so desired. Such passages are shown in the flow divider of the exploded views of FIGS. 10 and 11, with the flow divider 432 and its passages being shown in greater detail in FIG. 15. One side of the flow divider may be provided with a recess 460 along one side thereof, with the recess having a series of small holes or exhaust gas passages 462 formed therethrough. One (or both) wall(s) of the opposite side of the flow divider may include one or more exhaust gas passages 464 therethrough, to allow exhaust gas to diffuse through the flow divider. As in the case of the two separator plates, the flow divider may be formed without such diffuser passages, if so desired.

Figure 16:
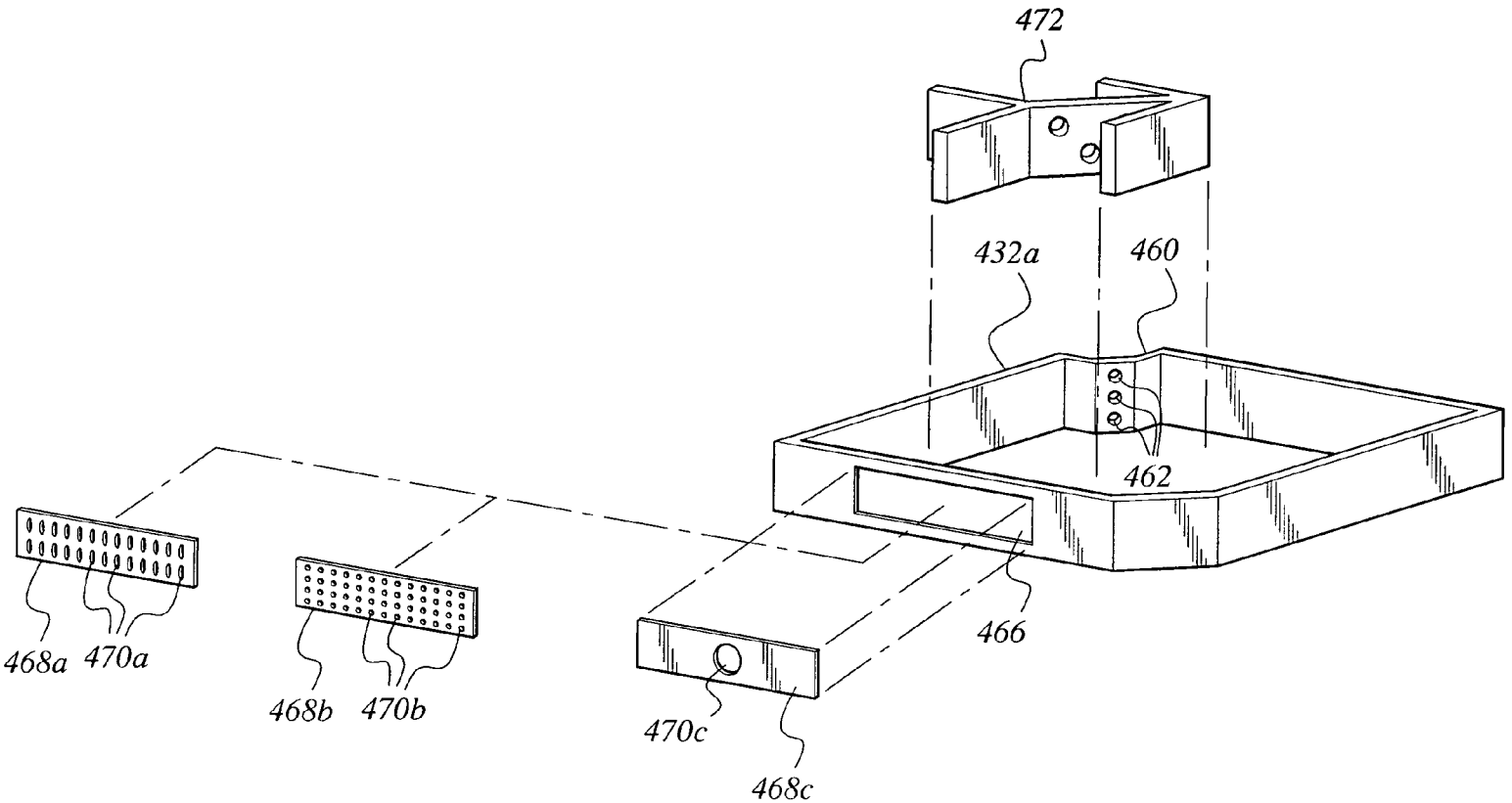
FIG. 16 is a detailed exploded perspective view of the rhomboid flow divider, showing various alternative embodiments thereof.

Alternatively, the flow divider may be manufactured with a relatively large opening 466 through one side thereof, as in the flow divider 432*a* of FIG. 16. Any one of a series of premanufactured plates 468*a*, 468*b*, 468*c*, etc. may be installed over the opening 466, with the plates 468*a* through 468*c* each having different configurations of diffuser passages or holes therethrough, e.g., louvers 470*a*, small holes 470*b*, a single large hole 470*b*, etc. Alternatively, such different diffuser passage configurations may be formed directly through the sidewall of the diffuser during manufacture, if desired. FIG. 16 further illustrates another alternative, in which a baffle 472 may be installed within the rhomboid flow divider, or in lieu of the rhomboid flow divider, if so desired.

Figure 19:
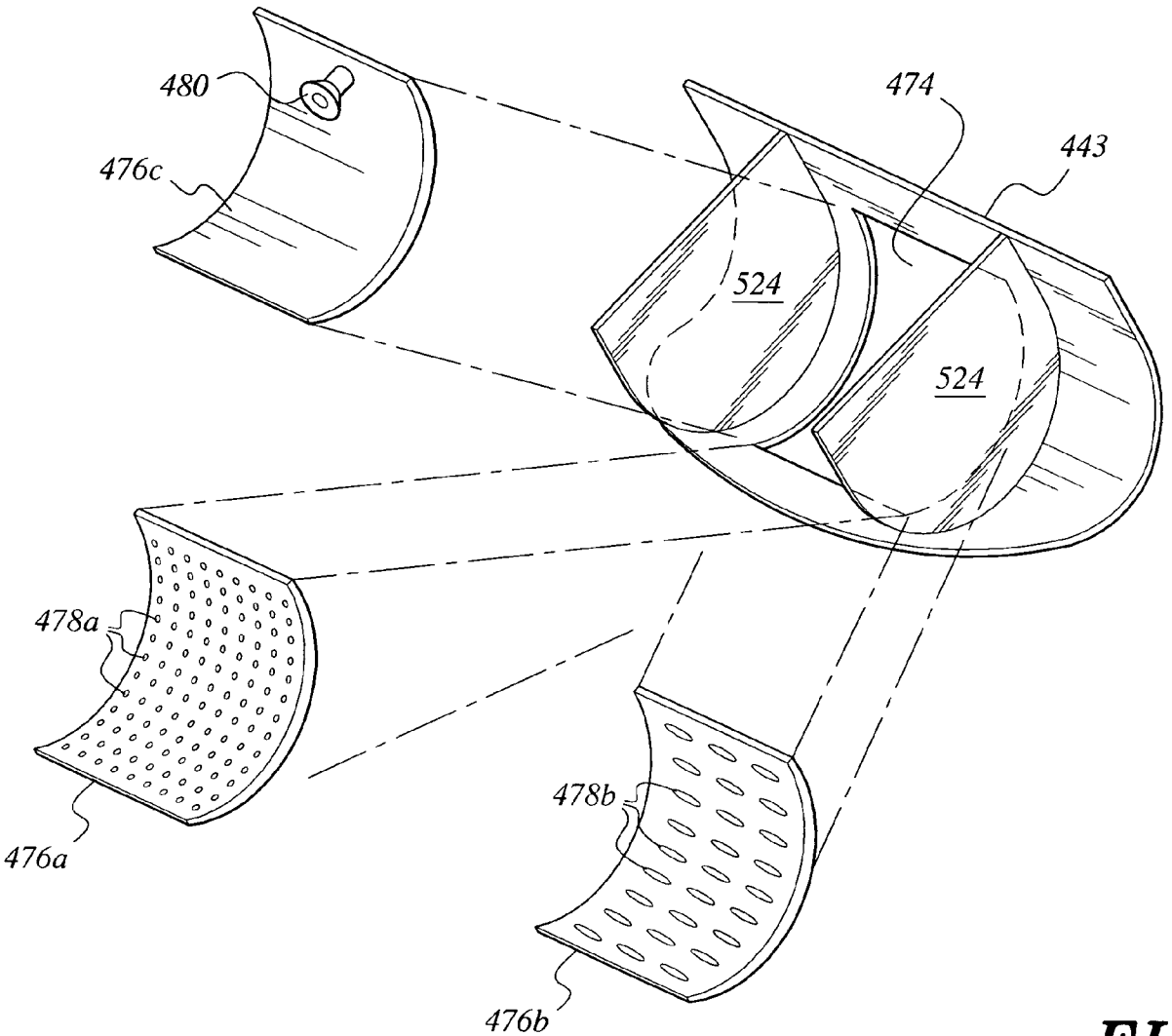
FIG. 19 is a detailed exploded perspective view of an exemplary gas flow guide vane for installation at the end of the sinusoidal flow path, showing various alternative panels, which may be incorporated therewith.

Either or both of the opposite first and second arcuate flow guides installed at the ends of the separator plates 428 and/or 430 (or other alternatives thereof), may also be provided with diffuser passages, if so desired. FIG. 19 illustrates such an alternative arcuate flow guide 443, with it being understood that the opposite arcuate flow guide could be configured similarly or identically if desired. The flow guide 443 includes a relatively large opening 474 formed therethrough in which any of a series of diffuser inserts may be installed, in much the same manner as the alternative diffuser inserts or plates 468*a* through 468*c* for the flow divider 432*a* shown in FIG. 16. In FIG. 19, a series of three different inserts 476*a* through 476*c* is illustrated, with the first insert 476*a* having a large number of relatively small passages 478*a* therethrough and the second insert 476*b* having a large number of relatively small louvers 478*b* formed therethrough. The third insert 476*c* includes a small venturi 480, configured to direct exhaust gas flow through the arcuate flow guide 443 and to entrain or otherwise influence the exhaust gas flow on the opposite side of the guide. Additional insert configurations may be provided as desired, and as in the case of the flow divider of FIG. 16, the arcuate flow guide 443 could be manufactured as a continuous sheet of material with the diffuser passages or venturi installed therein at the time of manufacture, if so desired.

Returning to FIGS. 10 and 11, it will be noted that the two lateral flow guides or fences 450 and 452 may also be provided with exhaust gas diffuser passages, if so desired. The first lateral flow guide 450 of FIG. 10 is provided with a relatively small number of relatively large passages 482 therethrough, while the second lateral guide 452 includes a larger number of relatively small passages 484 therethrough. The various additional flow guide components 446*a* through 448*b* may include holes, passages, louvers, etc. of various sizes as well, if so desired. These passages 482, 484, etc. allow exhaust gas to flow laterally from the primary sinusoidal exhaust gas flow path within the housing, to diffuse between the sides of the device. This outboard lateral flow may communicate with the first and second ends of the device, thereby providing multiple flow paths through the device.

The first and second separator plates 428 and 430, and structure captured therebetween, are supported within the housing 412 by a series of identical longitudinal supports 486. These supports 486 are formed of sheet material, with the orientation of the sheets being normal to the planes of the first and second separator plates. The supports may also include various passages therethrough, as shown in the alternate support configurations 486*a* and 486*b* of FIG. 12 with their large passages 488 and smaller passages 490. Such perforated supports 486*a*, 486*b*, etc. allow the exhaust gas to flow laterally from the volumes between the first and second separator plates and the housing or shell to communicate with other portions of the interior volume of the device, depending upon any such holes, passages, perforations, louvers, etc. formed through other internal components.

Figure 17:
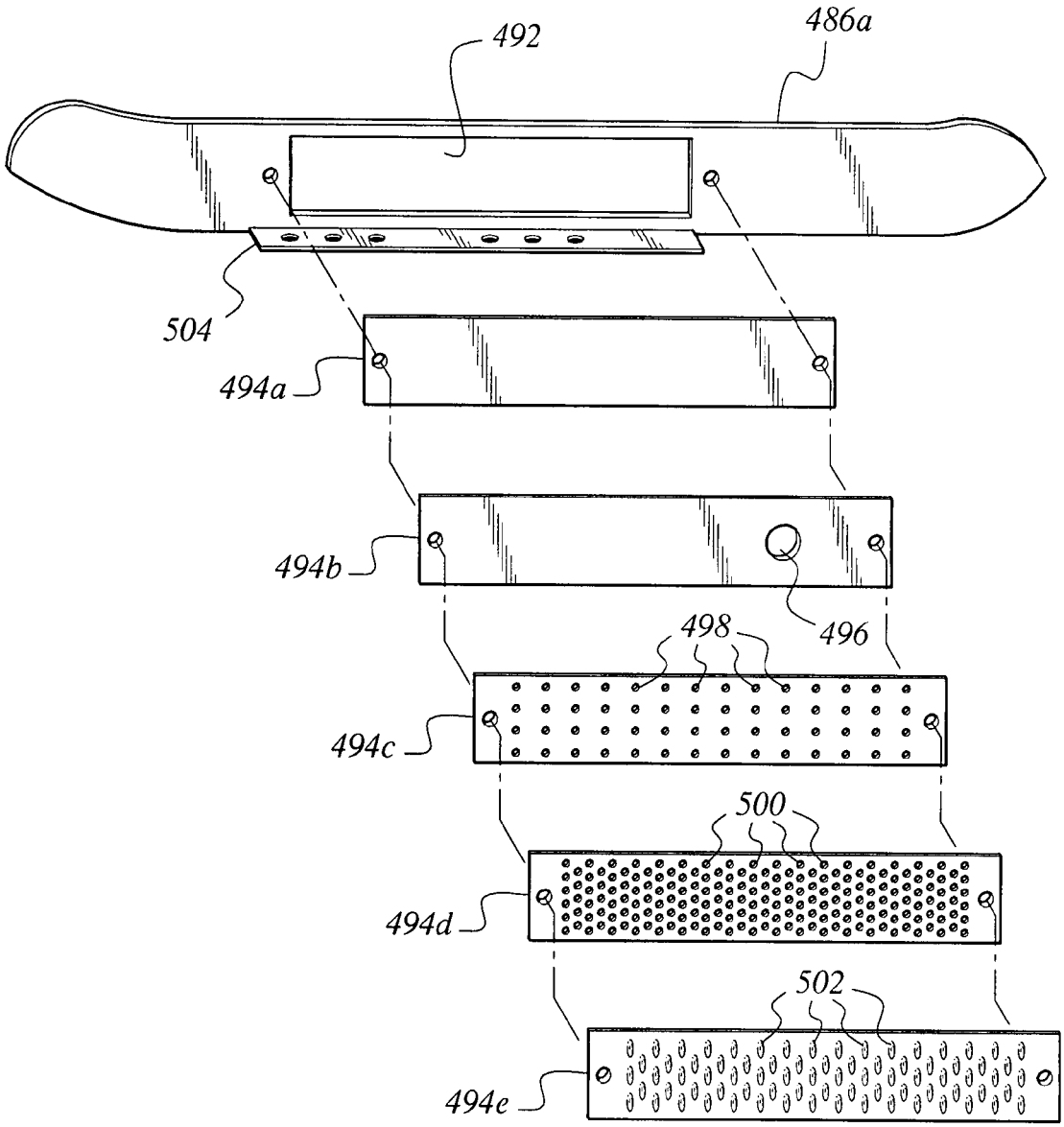
FIG. 17 is a detailed exploded perspective view of one of the lateral flow guides of the device of FIG. 11, illustrating a series of alternative panels that may be incorporated therewith.

FIG. 17 illustrates a further embodiment of a longitudinal support 486*a* having an elongate opening 492 formed therethrough, for the installation of a solid or perforated plate thereover as desired. A series of plates comprising a closed plate 494*a*, a plate 494*b* having a single relatively large hole 496 therethrough, a plate 494*c* having a larger number of smaller holes 498 therethrough, a plate 494*d* having an even larger number of still smaller holes 500 therethrough, and a plate 494*e* having a series of louvers 502 formed therethrough, are illustrated in FIG. 17. One of these plates may be installed as desired at the time of manufacture, or alternatively the longitudinal support 486*a* may be formed as a closed blank, identical to the supports 486 shown in FIG. 10, and the various holes, passages, louvers, etc. formed directly therein, as in other perforated components of the exhaust device discussed further above. The longitudinal plate 486*a* may include one or more attachment flanges 504, although it is preferred that the various components of the exhaust device in its various embodiments be welded and/or crimped to one another, rather than using mechanical fasteners.

Figure 20:
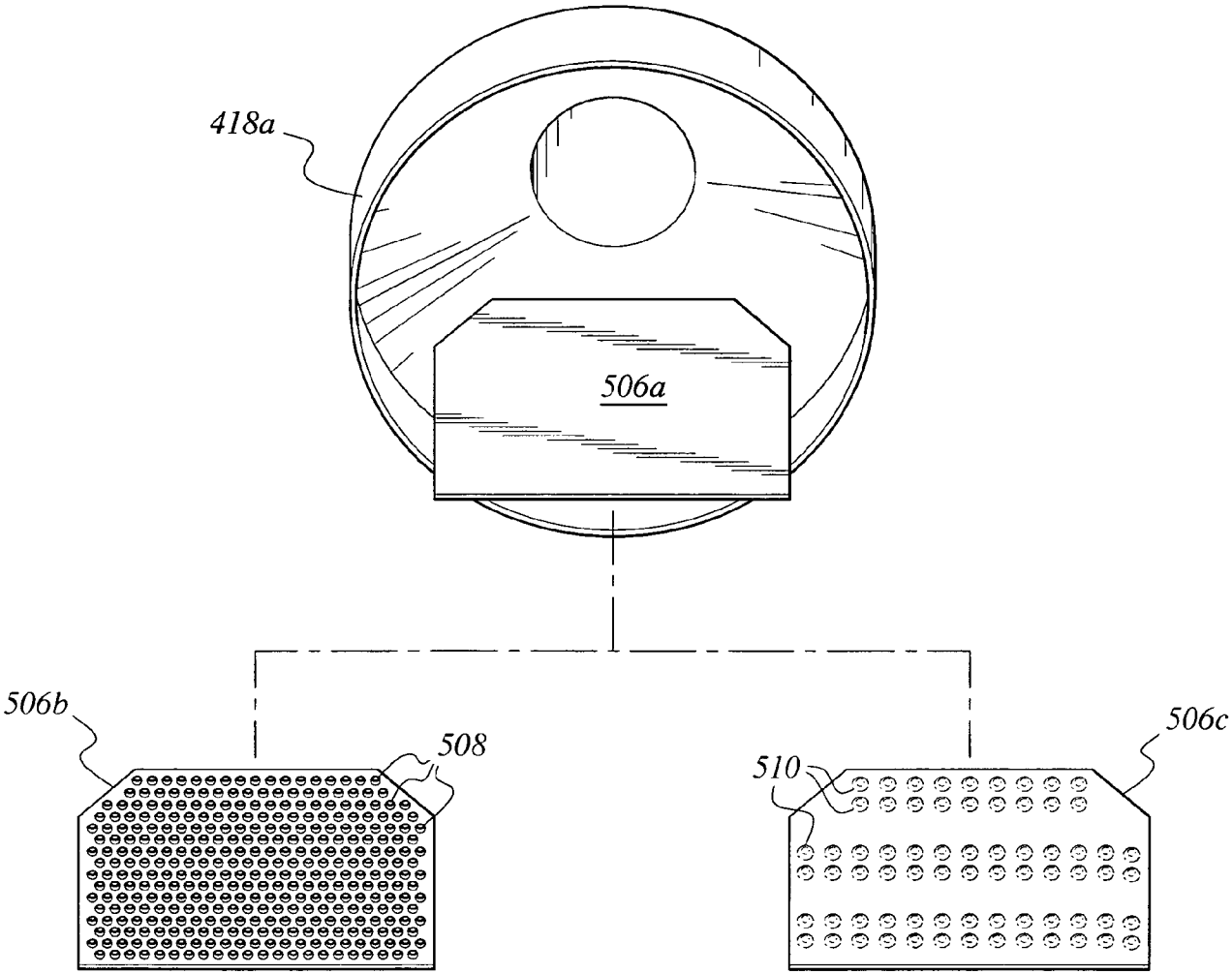
FIG. 20 is an exploded perspective view of an exemplary end structure of the device of FIG. 11, illustrating further details thereof and alternative baffles which may be incorporated therewith.

FIG. 20 provides an illustration of the internal configuration of an alternative end cover 418*a*, with the end cover including an additional internal end stiffening and diffuser plate therein. A series of three exemplary plates 506*a*, 506*b*, and 506*c* are illustrated in FIG. 20, with a solid plate 506*a* shown installed within the end cover 418*a*. Alternatively, a plate 506*b* having a series of small diffuser holes 508 therethrough, or a plate 506*c* having a series of small louvers 510 therethrough, may be installed in lieu of the solid plate 506*a*. The various holes, passages, louvers, etc. may be of any practicable size and number, and may be mixed in combination in any single plate or component, as noted further above. These internal end plates 506*a* through 506*c* perform two functions, in that they allow exhaust gases to flow therethrough (in the case of the perforated plates 506*b* and 506*c*), and also stiffen the end cover structure. The stiffening of the structure may provide significant advantages in terms of durability of the device, as discussed immediately below.

The construction of any device which contains a gas or other fluid which has varying pressure pulses during operation can lead to the cyclic flexing or bending of various components therein, particularly when those components are formed of relatively thin sheet metal. Accordingly, the present exhaust system device may include various stiffening ribs stamped or otherwise formed in various components. FIG. 11 illustrates an alternative exhaust device configuration 410*b*, in which various external and internal components include one or more stiffening ribs stamped or formed therein. The external housing or shell 412*b* may include a series of longitudinal (or other orientation) ribs 512 formed therein, with the ribs being either concave or convex, or various combinations thereof, depending upon the orientation of the die(s) used and the orientation of the material used to form the housing or shell 412*b*. The first and/or second separator plates 428 and/or 430 may also include one or more stiffening ribs therein, as indicated by the stiffening ribs 514 formed in the second separator plate 430 shown in FIG. 11. Similarly, the first and second arcuate flow guides 442*a* and 442*b* of FIG. 11 may also include stiffening ribs 516 formed therein, as may the first and second lateral flow guides 450 and 452 and the various longitudinal supports 486*a* and 486*b*.

In the case of the lateral flow guides, e.g., first guide 450 in FIG. 11, a single longitudinal rib 518 is formed therein, to reduce or obviate any inward and outward flexing due to periodic differential gas pressures to each side of the guide. The various longitudinal supports, e.g., supports 486*a* and 486*b*, may also include similar stiffening ribs, e.g., the single longitudinal rib 520 formed in each of the supports 486*a* and/or the series of shorter, diagonally disposed ribs 522 formed in the supports 486*b*. The flow, divider 432 may also include such stiffening ribs if so desired, e.g., shorter, diagonal ribs similar to the ribs 522 of the supports 486*b*. As the flow divider 432 is subject to vertical loads as well as differential pressures to each side, such relatively short, diagonal ribs serve to strengthen the divider vertically as well. Such stiffening ribs are not illustrated in the drawings for clarity in the drawings, but will be seen to be essentially the same as those stiffening ribs 522 illustrated on the supports 486*b*.

FIG. 19 further illustrates an alternative structure for stiffening the internal structure of the exhaust device. The arcuate flow guide 443 of FIG. 19 further includes a pair of stiffening webs 524, which may be applied to the flow guides 442 and/or 444 of the embodiment of FIG. 10 and/or other arcuate flow guide embodiments, if so desired. Such stiffeners eliminate or greatly reduce internal vibrations due to periodic pulsations in the exhaust gas flow, thereby reducing the occurrence of broken welds, separated parts due to metal fatigue, etc. Such additional stiffening webs, or similar structure, may be applied to any of the other structural components described further above as practicable, in lieu of or in addition to the various stiffening ribs formed in those components.

The various embodiments of the exhaust sound and emission control system may include additional features, if so desired. FIG. 13 illustrates an alternative configuration for the device, as well as illustrating the flow divider structure discussed further above. The embodiment 410*a* of FIG. 13 includes first and second catalytic converter elements, respectively 526 and 528, installed within the respective first and second ends 414*a* and 416*a* of the housing or shell 412*a* and adjacent to the corresponding first and second end covers 418 and 420. While these catalytic converter elements are not necessarily considered to be the primary exhaust catalyzing components of the exhaust system due to the relatively low temperatures generally achieved in the downstream muffler and/or resonator components of the system, these catalytic converter elements 526, 528 can nevertheless provide some additional degree of catalyzing of the exhaust gases. It will be seen that these additional catalytic converter elements 526, 528 may be installed in any of the embodiments of the exhaust system, as practicable.

FIG. 13 also illustrates an alternative configuration for the housing or shell of the exhaust device, with the housing 412*a* having a substantially concentric jacket 530 therearound. The jacket 530 is larger than the underlying housing 412*a* and spaced apart therefrom, with the jacket and housing defining a thermal and acoustic insulation volume 532 therebetween. The thermal and acoustic insulation volume may be filled with a suitable acoustic and/or thermal insulation material 534, e.g., loose fiberglass batt, stainless steel or other metal mesh or batt, etc., as desired. Moreover, the underlying housing or shell 412*a* may include a series of perforations or other passages 536 therethrough if so desired, allowing exhaust gases to communicate with the thermal and/or acoustic volume 532 and its insulation material 534 when the housing 412*a* is so perforated. It will be seen that such a surrounding jacket 530, as well as the insulation material 534, may be applied to any of the embodiments of the exhaust sound and emission control system, as desired.

Figure 18:
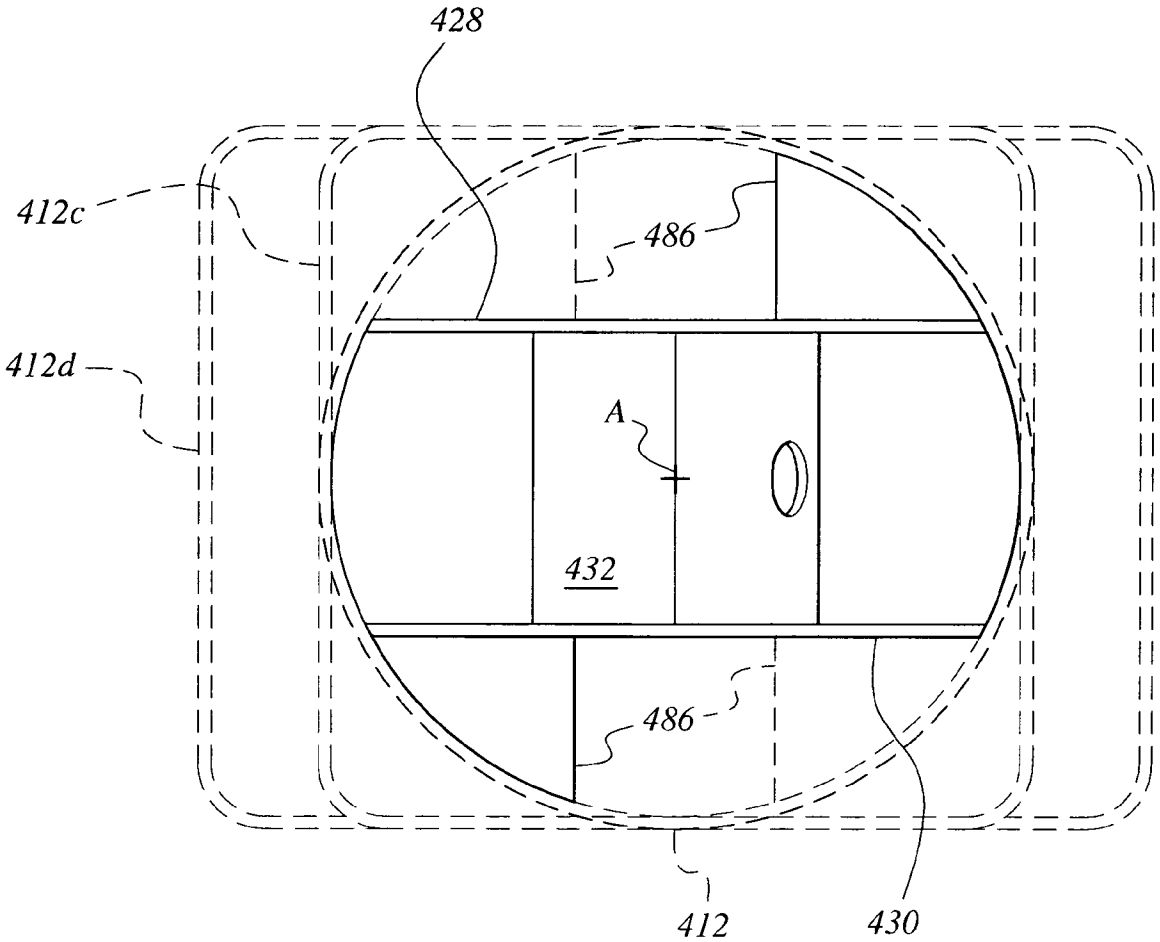
FIG. 18 is an end elevation view in section of the device of FIG. 11, further illustrating various alternative cross-sectional shapes and configurations for the device.

To this point, the housing or shell, and surrounding jacket if applied, have been indicated as being at least generally cylindrical in exterior shape. However, it will be seen that the exhaust device in its various embodiments need not have a cylindrical configuration. FIG. 18 is a cross sectional view of the exhaust sound and emission control system, illustrating a variety of different cross sectional shapes for the outer housing or shell. The innermost, cylindrical housing 412 is essentially the same as the housings illustrated at least partially in FIGS. 10 through 14. However, the exhaust device may incorporate an alternative housing 412*c* having a generally square cross section, or an alternative housing 412*d* having a rectangular cross section, each of which is shown centered about the central longitudinal axis A of the device. It will be seen that additional cross sectional shapes may be used as practicable. The interior components, e.g., the first and second separator plates 428 and 430, the central flow divider 432, the various longitudinal supports 486, etc., may be adjusted or reconfigured as required to fit properly within the various housing configurations 412*d*, 412*e*, etc. (It will be noted that two of the longitudinal supports 486 are shown in broken lines in FIG. 18 as optional in this, or other, embodiments.) Moreover, any surrounding jacket may also be configured to have a similar cross sectional shape to the selected housing, in order to provide an acoustic and insulating volume surrounding the housing as described further above.

In conclusion, the present exhaust sound and emission control systems greatly reduce the volume, and mass required for exhaust control devices, by incorporating all of the required components into a single device. The present systems in their various embodiments provide a number of variations on earlier devices developed by the present inventor, with these variations providing further exhaust sound and emission control for various vehicle and engine combinations. Accordingly, the present exhaust systems in their various embodiments will prove to be most valuable components for installation both as original equipment or as aftermarket devices.

It is to be understood that the present invention is not limited to the embodiments described above, but encompasses any and all embodiments within the scope of the following claims.

I claim:

1. An exhaust sound and emission control system, comprising:

an elongate housing having a first end, a second end opposite the first end, and a major axis;

a first end cover and a second end cover secured to and sealing the first end and the second end of the housing, respectively, the covers and the housing defining an interior volume therebetween;

a first end pipe and a second end pipe, respectively penetrating and extending from the first end cover and from the second end cover and communicating with the interior volume;

a first separator plate disposed within the housing parallel to the major axis thereof, the first separator plate having a first end and a second end opposite the first end;

a second separator plate disposed within the housing parallel to and spaced apart from the first separator plate, the second separator plate having a first end and a second end opposite the first end;

a substantially rhomboid flow divider disposed between the first separator plate and the second separator plate, wherein the flow divider, the first separator plate, and the second separator plate define mutually separate first and second primary gas flow paths through the housing;

a first arcuate flow guide extending from the first end of the first separator plate, the first arcuate flow guide having a radius of curvature originating from the second end of the second separator plate; and a second arcuate flow guide extending from the first end of the second separator plate, the second arcuate flow guide having a radius of curvature originating from the second end of the first separator plate, the first separator plate, first arcuate flow guide, second separator plate, and second arcuate flow guide defining a sinusoidal exhaust gas path within the housing.

2. The exhaust sound and emission control system according to claim 1, further including:

a first lateral flow guide disposed between the first separator plate and the second separator plate; and a second lateral flow guide disposed between the first separator plate and the second separator plate laterally opposite the first lateral flow guide, the flow divider, first separator plate, second separator plate, first lateral flow guide, and second lateral flow guide defining mutually separate first and second primary gas flow paths through the housing, the first and second primary gas flow paths each being of substantially equal cross-sectional area and having substantially constant cross sections.

3. The exhaust sound and emission control system according to claim 1, further including at least one catalytic converter element disposed internally adjacent to at least one of the end covers.

4. The exhaust sound and emission control system according to claim 1, further including:

a first lateral flow guide disposed between the first separator plate and the second separator plate;

a second lateral flow guide disposed between the first separator plate and the second separator plate laterally opposite the first lateral flow guide; and at least one of the first separator plate, the second separator plate, the flow divider, the first arcuate flow guide, the second arcuate flow guide, the first lateral flow guide, and the second lateral flow guide having at least one diffuser passage therethrough.

5. The exhaust sound and emission control system according to claim 1, further including:

a first lateral flow guide disposed between the first separator plate and the second separator plate;

a second lateral flow guide disposed between the first separator plate and the second separator plate laterally opposite the first lateral flow guide; and at least one of the housing, the first separator plate, the second separator plate, the flow divider, the first arcuate flow guide, the second arcuate flow guide, the first lateral flow guide, and the second lateral flow guide further including at least one stiffening rib therein.

6. The exhaust sound and emission control system according to claim 1, further including a jacket disposed concentrically about the housing and spaced apart therefrom, the jacket and housing defining a thermal and acoustic insulation volume therebetween.

7. An exhaust sound and emission control system, comprising:

an elongate housing having a first end, a second end opposite the first end, and a major axis;

a first end cover and a second end cover secured to and sealing the first end and the second end of the housing, respectively, the covers and the housing defining an interior volume therebetween;

a first end pipe and a second end pipe penetrating and extending from the first end cover and from the second end cover, respectively, the pipes communicating with the interior volume;

a first separator plate disposed within the housing parallel to the major axis thereof, the first separator plate having a first end and a second end opposite the first end;

a second separator plate disposed within the housing parallel to the first separator plate, the second separator plate having a first end and a second end opposite the first end;

a first arcuate flow guide extending from the first end of the first separator plate, the first arcuate flow guide having a radius of curvature originating from the second end of the second separator plate; and a second arcuate flow guide extending from the first end of the second separator plate, the second arcuate flow guide having a radius of curvature originating from the second end of the first separator plate;

wherein the first separator plate, the first arcuate flow guide, the second separator plate, and the second arcuate flow guide define a sinusoidal exhaust gas path within the housing.

8. The exhaust sound and emission control system according to claim 7, wherein the flow divider comprises a substantially rhomboid configuration.

9. The exhaust sound and emission control system according to claim 7, further including:

a first lateral flow guide disposed between the first separator plate and the second separator plate; and a second lateral flow guide disposed between the first separator plate and the second separator plate laterally opposite the first lateral flow guide, the flow divider, the first separator plate, the second separator plate, the first lateral flow guide, and the second lateral flow guide defining mutually separate first and second primary gas flow paths through the housing, the first and second primary gas flow paths each being of substantially equal cross-sectional area and having substantially constant cross sections.

10. The exhaust sound and emission control system according to claim 7, further including at least one catalytic converter element disposed internally adjacent to at least one of the end covers.

11. The exhaust sound and emission control system according to claim 7, further including:

a first arcuate flow guide extending from the first end of the first separator plate;

a second arcuate flow guide extending from the first end of the second separator plate;

a first lateral flow guide disposed between the first separator plate and the second separator plate;

a second lateral flow guide disposed between the first separator plate and the second separator plate laterally opposite the first lateral flow guide; and at least one of the first separator plate, the second separator plate, the flow divider, the first arcuate flow guide, the second arcuate flow guide, the first lateral flow guide, and the second lateral flow guide having at least one diffuser passage therethrough.

12. The exhaust sound and emission control system according to claim 7, further including:

a first arcuate flow guide extending from the first end of the first separator plate;

a second arcuate flow guide extending from the first end of the second separator plate;

a first lateral flow guide disposed between the first separator plate and the second separator plate;

a second lateral flow guide disposed between the first separator plate and the second separator plate laterally opposite the first lateral flow guide; and at least one of the housing, the first separator plate, the second separator plate, the flow divider, the first arcuate flow guide, the second arcuate flow guide, the first lateral flow guide, and the second lateral flow guide further including at least one stiffening rib therein.

13. The exhaust sound and emission control system according to claim 7, further including a jacket disposed concentrically about the housing and spaced apart therefrom, the jacket and housing defining a thermal and acoustic insulation volume therebetween.

14. An exhaust sound and emission control system, comprising:

an elongate housing having a first end, a second end opposite the first end, and a major axis;

a first end cover and a second end cover secured to and sealing the first end and the second end of the housing, respectively, the covers and the housing defining an interior volume therebetween;

a first end pipe and a second end pipe penetrating and extending from the first end cover and from the second end cover, respectively, the pipes communicating with the interior volume;

a first separator plate disposed within the housing parallel to the major axis thereof, the first separator plate having a first end and a second end opposite the first end;

a second separator plate disposed within the housing parallel to and spaced apart from the first separator plate, the second separator plate having a first end and a second end opposite the first end;

a flow divider disposed between the first separator plate and the second separator plate along the major axis of the housing, wherein the flow divider, the first separator plate, and the second separator plate define mutually separate first and second primary gas flow paths through the housing, the first and second primary gas flow paths each being of substantially equal cross-sectional area and having substantially constant cross sections;

a first arcuate flow guide extending from the first end of the first separator plate, the first arcuate flow guide having a radius of curvature originating from the second end of the second separator plate; and a second arcuate flow guide extending from the first end of the second separator plate, the second arcuate flow guide having a radius of curvature originating from the second end of the first separator plate;

wherein the first separator plate, the first arcuate flow guide, the second separator plate, and the second arcuate flow guide define a sinusoidal exhaust gas path within the housing.

15. The exhaust sound and emission control system according to claim 14, wherein the flow divider comprises a substantially rhomboid configuration.

16. The exhaust sound and emission control system according to claim 14, further including at least one catalytic converter element disposed internally adjacent to at least one of the end covers.

17. The exhaust sound and emission control system according to claim 14, further including:

a first lateral flow guide disposed between the first separator plate and the second separator plate;

a second lateral flow guide disposed between the first separator plate and the second separator plate laterally opposite the first lateral flow guide; and at least one of the first separator plate, the second separator plate, the flow divider, the first arcuate flow guide, the second arcuate flow guide, the first lateral flow guide, and the second lateral flow guide having at least one diffuser passage therethrough and at least one stiffening rib therein.

18. The exhaust sound and emission control system according to claim 14, further including a jacket disposed concentrically about the housing and spaced apart therefrom, the jacket and housing defining a thermal and acoustic insulation volume therebetween.

* * * * *